US009252899B2

(12) United States Patent
Pahuja et al.

(10) Patent No.: US 9,252,899 B2
(45) Date of Patent: Feb. 2, 2016

(54) ADAPTIVE BANDWIDTH MANAGEMENT OF IBOC AUDIO SIGNALS DURING BLENDING

(75) Inventors: Ashwini Pahuja, Albertson, NY (US); Jason Tsuchi Jen, East Brunswick, NJ (US)

(73) Assignee: iBiquity Digital Corporation, Columbia, MD (US)

( * ) Notice: Subject to any disclaimer, the term of this patent is extended or adjusted under 35 U.S.C. 154(b) by 683 days.

(21) Appl. No.: 13/533,556

(22) Filed: Jun. 26, 2012

(65) Prior Publication Data

US 2013/0343547 A1 Dec. 26, 2013

(51) Int. Cl.
*H04H 20/47* (2008.01)
*H04H 40/36* (2008.01)

(52) U.S. Cl.
CPC ..... *H04H 40/36* (2013.01); *H04H 2201/18* (2013.01)

(58) Field of Classification Search
CPC ..... H04H 20/30; H04H 20/47; H04H 20/48; H04H 20/49; H04H 40/00; H04H 40/18; H04H 40/63; H04H 60/11; H04H 2201/183; H04H 2201/186; H03D 1/24; H03K 9/00; H04B 1/06; H04B 1/16; H04B 1/66; H04B 3/04; H04B 3/46; H04B 7/00; H04B 7/005; H04B 7/08
USPC ..... 381/1–7, 10–23, 56, 61; 375/216, 346, 375/347, 349, 240, 260, 267, 268, 299, 227, 375/232, 240.02, 259, 316, 320, 340; 370/486, 204; 455/277.2, 283, 501, 455/63.1, 108, 114.2, 114.3, 130, 135, 137, 455/139, 140, 177.1, 44.45, 47, 59, 60, 61, 455/203, 204, 205; 700/94
See application file for complete search history.

(56) References Cited

U.S. PATENT DOCUMENTS

| | | | | |
|---|---|---|---|---|
| 5,809,065 | A | 9/1998 | Dapper et al. | |
| 5,949,796 | A | 9/1999 | Kumar | |
| 6,178,317 | B1 * | 1/2001 | Kroeger et al. | 455/296 |
| 6,243,424 | B1 | 6/2001 | Kroeger et al. | |
| 6,259,893 | B1 | 7/2001 | Kroeger et al. | |
| 6,563,880 | B1 | 5/2003 | Hunsinger et al. | |
| 6,590,944 | B1 | 7/2003 | Kroeger | |
| 6,622,008 | B2 | 9/2003 | Kroeger et al. | |
| 6,671,340 | B1 | 12/2003 | Kroeger et al. | |
| 6,735,257 | B2 | 5/2004 | Kroeger | |
| 6,901,242 | B2 | 5/2005 | Kroeger et al. | |
| 6,970,685 | B2 | 11/2005 | Milbar et al. | |
| 7,221,688 | B2 | 5/2007 | Vanness | |

(Continued)

OTHER PUBLICATIONS

International Search Report and Written Opinion for PCT Application No. PCT/US2013/047859 mailed Jan. 31, 2014.

(Continued)

*Primary Examiner* — Leshui Zhang
(74) *Attorney, Agent, or Firm* — Terrile, Cannatti, Chambers & Holland, LLP; Michael Rocco Cannatti

(57) ABSTRACT

A method and apparatus are provided for smoothly blending analog and digital portions of a composite digital audio broadcast signal by using look ahead metrics computed from previously received audio frames to dynamically adjust either stereo separation or bandwidth or both of the digital audio portion of the digital audio broadcast signal to produce an adjusted digital audio portion that is blended with the analog audio portion.

20 Claims, 11 Drawing Sheets

(56) References Cited

U.S. PATENT DOCUMENTS

| | | | | |
|---|---|---|---|---|
| 7,546,088 | B2 | 6/2009 | Kroeger et al. | |
| 7,885,628 | B2 | 2/2011 | Kobayashi | |
| 7,944,998 | B2 | 5/2011 | Shridhar et al. | |
| 2004/0043730 | A1 * | 3/2004 | Schill et al. | 455/130 |
| 2006/0019601 | A1 * | 1/2006 | Kroeger et al. | 455/3.06 |
| 2007/0293167 | A1 * | 12/2007 | Shridhar et al. | 455/130 |
| 2009/0036085 | A1 * | 2/2009 | Kobayashi | 455/296 |
| 2010/0027719 | A1 | 2/2010 | Pahuja | |
| 2011/0274214 | A1 | 11/2011 | Shah et al. | |

OTHER PUBLICATIONS

Texas Instruments, Real World Signal Processing, Product Bulletin, TMS320DRI300/350 HD Radio Digital Basebands, 2004.

International Preliminary Report on Patentabiilty for PCT Application No. PCT/US2013/047859 mailed Dec. 31, 2014.

* cited by examiner

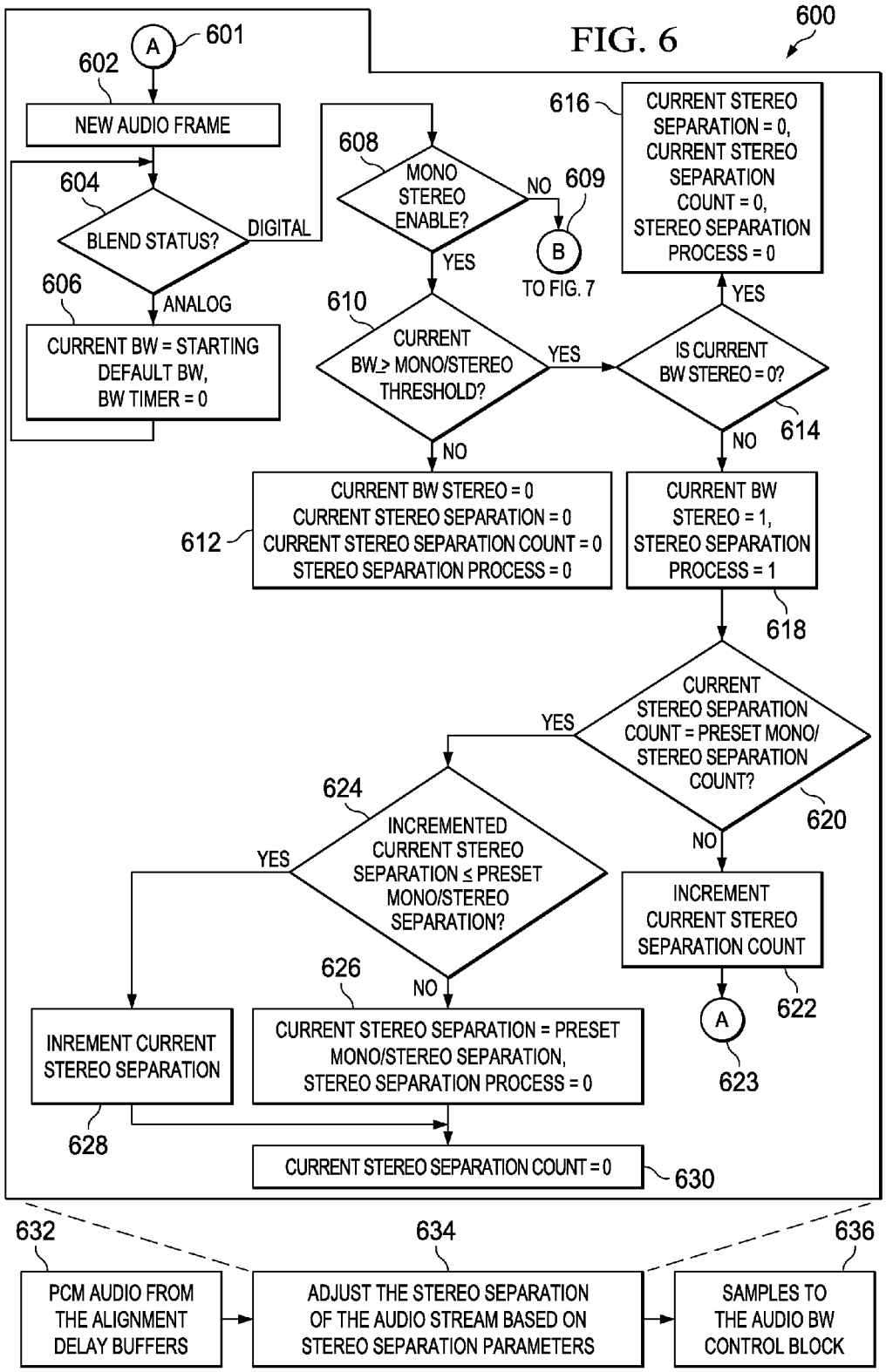
FIG. 6
600
601
A
602
NEW AUDIO FRAME
604
BLEND STATUS?
DIGITAL
ANALOG
606
CURRENT BW = STARTING DEFAULT BW, BW TIMER = 0
608
MONO STEREO ENABLE?
NO
609
B
TO FIG. 7
YES
610
CURRENT BW ≥ MONO/STEREO THRESHOLD?
YES
NO
612
CURRENT BW STEREO = 0
CURRENT STEREO SEPARATION = 0
CURRENT STEREO SEPARATION COUNT = 0
STEREO SEPARATION PROCESS = 0
616
CURRENT STEREO SEPARATION = 0, CURRENT STEREO SEPARATION COUNT = 0, STEREO SEPARATION PROCESS = 0
YES
IS CURRENT BW STEREO = 0?
614
NO
CURRENT BW STEREO = 1, STEREO SEPARATION PROCESS = 1
618
CURRENT STEREO SEPARATION COUNT = PRESET MONO/ STEREO SEPARATION COUNT?
YES
620
NO
624
INCREMENTED CURRENT STEREO SEPARATION ≤ PRESET MONO/STEREO SEPARATION?
YES
NO
INCREMENT CURRENT STEREO SEPARATION COUNT
622
A
623
626
CURRENT STEREO SEPARATION = PRESET MONO/STEREO SEPARATION, STEREO SEPARATION PROCESS = 0
INREMENT CURRENT STEREO SEPARATION
628
CURRENT STEREO SEPARATION COUNT = 0
630
632
PCM AUDIO FROM THE ALIGNMENT DELAY BUFFERS
634
ADJUST THE STEREO SEPARATION OF THE AUDIO STREAM BASED ON STEREO SEPARATION PARAMETERS
636
SAMPLES TO THE AUDIO BW CONTROL BLOCK

BANDWIDTH MANAGEMENT 700

ADAPTIVE BANDWIDTH MANAGEMENT OF IBOC AUDIO SIGNALS DURING BLENDING

BACKGROUND OF THE INVENTION

1. Field of the Invention

The present invention is directed in general to composite digital radio broadcast receivers and methods for operating same. In one aspect, the present invention relates to methods and apparatus for blending digital and analog portions of an audio signal in a radio receiver.

2. Description of the Related Art

Digital radio broadcasting technology delivers digital audio and data services to mobile, portable, and fixed receivers using existing radio bands. One type of digital radio broadcasting, referred to as in-band on-channel (IBOC) digital radio broadcasting, transmits digital radio and analog radio broadcast signals simultaneously on the same frequency using digitally modulated subcarriers or sidebands to multiplex digital information on an AM or FM analog modulated carrier signal. HD Radio™ technology, developed by iBiquity Digital Corporation, is one example of an IBOC implementation for digital radio broadcasting and reception. With this arrangement, the audio signal can be redundantly transmitted on the analog modulated carrier and the digitally modulated subcarriers by transmitting the analog audio AM or FM backup audio signal (which is delayed by the diversity delay) so that the analog AM or FM backup audio signal can be fed to the audio output when the digital audio signal is absent, unavailable, or degraded. In these situations, the analog audio signal is gradually blended into the output audio signal by attenuating the digital signal such that the audio is fully blended to analog as the digital signal become unavailable. Similar blending of the digital signal into the output audio signal occurs as the digital signal becomes available by attenuating the analog signal such that the audio is fully blended to digital as the digital signal becomes available.

Notwithstanding the smoothness of the blending function, blend transitions between analog and digital signals can degrade the listening experience when the audio differences between the analog and digital signals are significant. Accordingly, a need exists for improved method and apparatus for processing the digital audio to overcome the problems in the art, such as outlined above. Further limitations and disadvantages of conventional processes and technologies will become apparent to one of skill in the art after reviewing the remainder of the present application with reference to the drawings and detailed description which follow.

BRIEF DESCRIPTION OF THE DRAWINGS

The present invention may be understood, and its numerous objects, features and advantages obtained, when the following detailed description is considered in conjunction with the following drawings, in which:

FIG. 6 illustrates an exemplary process for adjusting the stereo separation of an audio stream while blending audio samples of a digital portion of a radio broadcast signal with audio samples of an analog portion of the radio broadcast signal;

DETAILED DESCRIPTION

Figure 1:
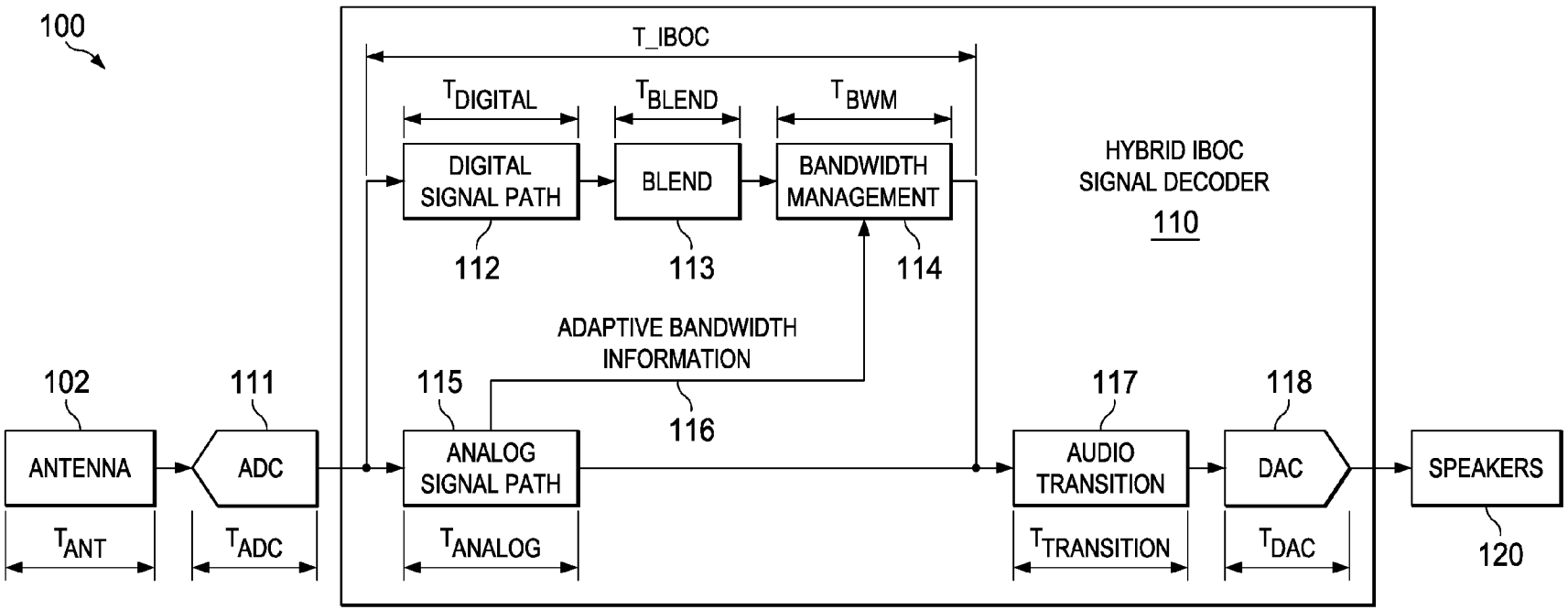
FIG. 1 illustrates a simplified timing block diagram of an exemplary digital broadcast receiver which uses analog signal characteristics as an initial setting to adaptively control the signal bandwidth when aligning and blending digital and analog audio signals in accordance with selected embodiments.

A digital radio receiver apparatus and associated methods for operating same are described for efficiently blending digital and analog signals by adaptively managing the signal bandwidth for an-band on-channel (IBOC) digital radio broadcast signal to provide smooth transitions of the IBOC signal during blending of low bandwidth analog signals and high bandwidth digital signals. To prevent audible disruptions that occur when blending a low bandwidth audio signal (analog audio) with a high bandwidth audio signal (IBOC) or vice versa, the digital audio bandwidth is adaptively controlled to transition smoothly with the analog audio bandwidth. Bandwidth control can be accomplished by extracting digital signal quality values (e.g., signal-to-noise measures computed at each audio frame) and/or selected analog signal characteristics over time from the received signal by the receiver's modem front end, and then using the extracted signal information at the receiver's back end processor to control the blending of digital and analog signals. For example, audio samples from an analog demodulated signal may be processed to extract or compute analog signal characteristic information (e.g., signal pitch, loudness, and bandwidth) which can be used to control or manage the bandwidth and/or loudness settings for the digital demodulator. With adaptive bandwidth management, a digital signal that is first acquired has its digital audio bandwidth set to a minimum level (e.g., mono mode) corresponding to the audio bandwidth of the analog signal which is also in mono mode. The digital audio bandwidth may then be slowly expanded based on the signal conditions, thereby stepping up the signal bandwidth from the analog signal bandwidth (e.g., 4.5 kHz bandwidth or lower for AM analog audio signals) to the digital signal bandwidth (e.g., 15 kHz bandwidth for AM digital IBOC audio signals). In addition, the audio signal should transition from mono to stereo mode to bring out the higher fidelity as signal conditions permit. Adaptive bandwidth management may also be used in the reverse direction when signal conditions degrade (for example, in the presence of interference or loss of digital signal) by slowly reducing the digital audio bandwidth to a minimum. During shrinking of digital audio bandwidth, the stereo audio signal should be slowly reduced to the mono component so that the listener perceives a smooth and seamless audio signal during the blend operation.

Various illustrative embodiments of the present invention will now be described in detail with reference to the accompanying figures. While various details are set forth in the following description, it will be appreciated that the present invention may be practiced without these specific details, and that numerous implementation-specific decisions may be made to the invention described herein to achieve the device designer's specific goals, such as compliance with process technology or design-related constraints, which will vary from one implementation to another. While such a development effort might be complex and time-consuming, it would nevertheless be a routine undertaking for those of ordinary skill in the art having the benefit of this disclosure. For example, selected aspects are shown in block diagram form, rather than in detail, in order to avoid limiting or obscuring the present invention. Some portions of the detailed descriptions provided herein are presented in terms of algorithms and instructions that operate on data that is stored in a computer memory. Such descriptions and representations are used by those skilled in the art to describe and convey the substance of their work to others skilled in the art. In general, an algorithm refers to a self-consistent sequence of steps leading to a desired result, where a "step" refers to a manipulation of physical quantities which may, though need not necessarily, take the form of electrical or magnetic signals capable of being stored, transferred, combined, compared, and otherwise manipulated. It is common usage to refer to these signals as bits, values, elements, symbols, characters, terms, numbers, or the like. These and similar terms may be associated with the appropriate physical quantities and are merely convenient labels applied to these quantities. Unless specifically stated otherwise as apparent from the following discussion, it is appreciated that, throughout the description, discussions using terms such as "processing" or "computing" or "calculating" or "determining" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

Referring now to FIG. 1, there is shown a simplified timing block diagram of an exemplary digital broadcast receiver 100 which uses analog signal characteristics as an initial setting to adaptively control the signal bandwidth when aligning and blending digital and analog audio signals contained in a received hybrid radio broadcast signal in accordance with selected embodiments. Upon reception at the antenna 102, the received hybrid signal is processed for an amount of time $T_{ANT}$ which is typically a constant amount of time that will be implementation dependent. The received hybrid signal is then digitized, demodulated, and decoded by the IBOC signal decoder 110, starting with an analog-to-digital converter (ADC) 111 which processes the signal for an amount of time $T_{ADC}$ which is typically an implementation-dependent constant amount of time to produce digital samples which are down converted to produce lower sample rate output digital signals. In the IBOC signal decoder 110, the digitized hybrid signal is split into a digital signal path 112 and an analog signal path 115 for demodulation and decoding.

In the digital signal path 112, the hybrid signal decoder 110 acquires and demodulates the received digital IBOC signal for an amount of time $T_{DIGITAL}$, where $T_{DIGITAL}$ is a variable amount of time that will depend on the acquisition time of the digital signal and the demodulation times of the digital signal path 112. The acquisition time can vary depending on the strength of the digital signal due to radio propagation interference such as fading and multipath. The digital signal path 112 applies Layer 1 processing to demodulate the received digital IBOC signal using a fairly deterministic process that provides very little or no buffering of data based on a particular implementation. The digital signal path 112 then feeds the resulting data to one or more upper layer modules which decode the demodulated digital signal to maximize audio quality. In selected embodiments, the upper layer decoding process involves buffering of the received signal based on over-the-air conditions. In selected embodiments, the upper layer module(s) may implement a deterministic process for each IBOC service mode (MP1-MP3, MP5, MP6, MP11, MA1 and MA3). As depicted, the upper layer decoding process includes a blend decision module 113 and a bandwidth management module 114. The blend decision module 113 processes look ahead metrics obtained from the demodulated digital signal in the digital signal path 112 to guide the blending of the audio and analog signals in the audio transition or blending module 115. The time required to process the blend decision at the blend decision module 113 is a constant amount of time $T_{BLEND}$. The bandwidth management module 114 dynamically processes look ahead metrics and/or upper layer signal metric information extracted from the demodulated digital signal in the digital signal path 113 to adaptively control the digital audio bandwidth that is used when blending the analog audio frames with the realigned digital audio frames. In this way, previously-computed look ahead metrics and/or upper layer quality indicators may be used to obtain a priori knowledge of the incoming signal for managing the digital audio bandwidth to slowly increase and decrease the digital audio bandwidth to prevent abrupt bandwidth changes which will lead to listener fatigue. The time required to process the signal metrics at the bandwidth management module 114 is a constant amount of time $T_{BWM}$. In this example, the total time $T_{IBOC}$ spent demodulating and decoding the digital IBOC signal is deterministic for a particular implementation.

In the analog path 115, the received analog portion of the hybrid signal is processed for an amount of time $T_{ANALOG}$ to produce audio samples representative of the analog portion of the received hybrid signal, where $T_{ANALOG}$ is typically a constant amount of time that is implementation dependent. In addition, the analog path 115 may include signal processing circuitry for processing audio samples from the analog demodulated signal to compute or extract predetermined analog signal characteristic information, such as signal pitch, loudness, and/or analog bandwidth information. As indicated at signal line 116, the predetermined analog signal characteristic information may be provided to the bandwidth management module 114 for use in controlling the settings for the bandwidth and loudness for the IBOC demodulated signal. In embodiments where the analog signal characteristic information is not available to be conveyed at signal line 116 in real time, the bandwidth management module 114 may store analog signal characteristic values that are computed empirically and used as a starting point to initialize the digital audio bandwidth and loudness settings.

At the audio transition or blending module 117, the samples from the digital signal (provided via blend decision module 113 and bandwidth management module 114) are aligned and blended with the samples from the analog signal (provided directly from the analog signal path 115) using guidance control signaling from the blend decision module 113 to avoid unnecessary blending from analog to digital if the look ahead metrics for the digital signal are not good. The time required to align and blend the digital and analog signals together at the audio transition module 117 is a constant amount of time $T_{TRANSITION}$. Finally, the combined digitized audio signal is converted into analog for rendering via the digital-to-analog converter (DAC) 118 during processing time $T_{DAC}$ which is typically a constant amount of time that will be implementation-dependent.

Figure 2:
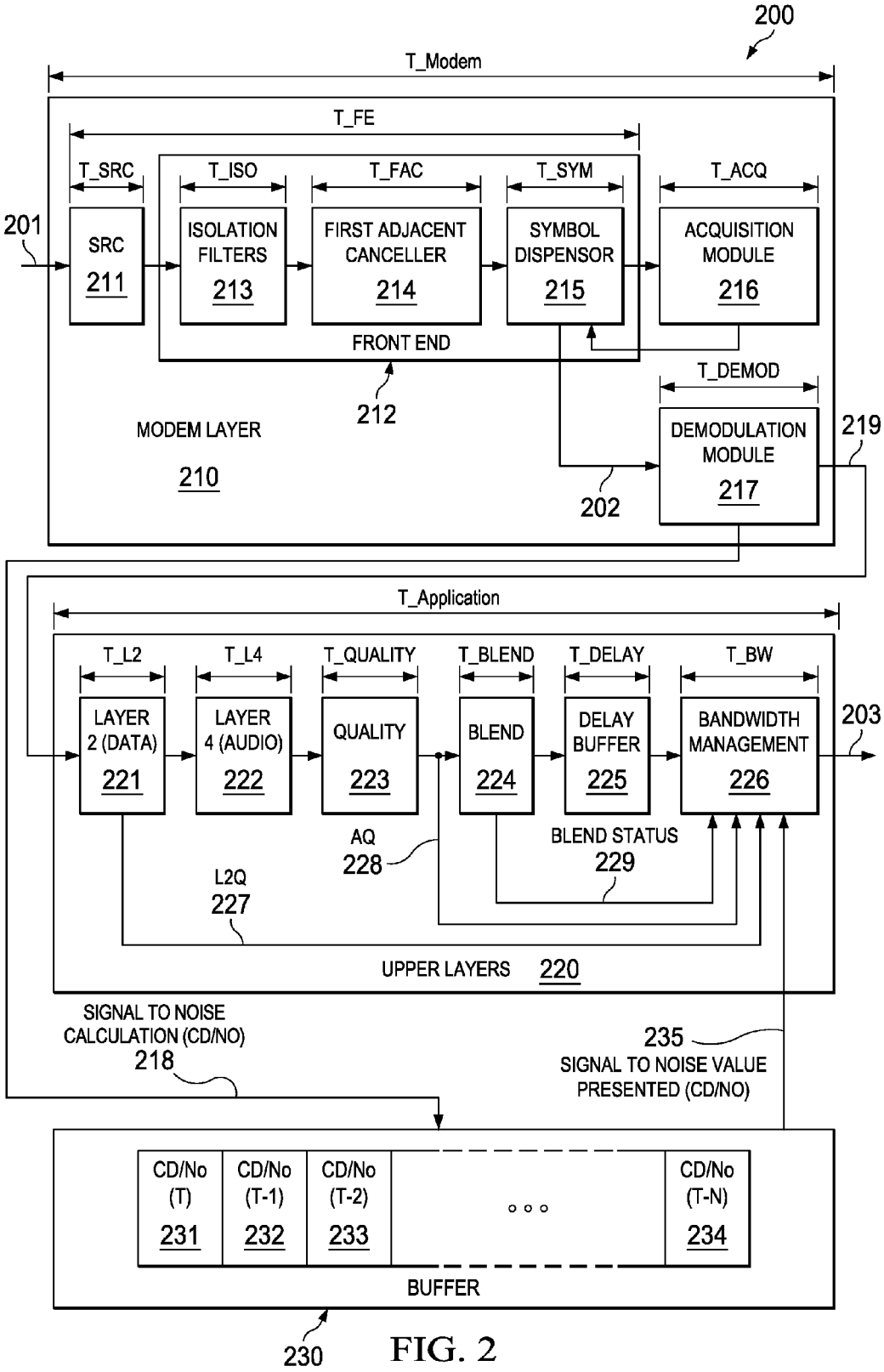
FIG. 2 illustrates a simplified timing block diagram of an exemplary digital broadcast receiver which uses look ahead signal metrics and upper layer quality indicators to adaptively control the bandwidth during blending of digital and analog audio FM signals in accordance with selected embodiments.

An exemplary functional block diagram of an exemplary digital broadcast receiver 200 for adaptively controlling the bandwidth during blending of digital and analog audio signals is illustrated in FIG. 2 which illustrates functional processing details of a modem layer module 210 and application layer module 220. The functions illustrated in FIG. 2 can be performed in whole or in part in a baseband processor or similar processing system that includes one or more processing units configured (e.g., programmed with software and/or firmware) to perform the specified functionality and that is suitably coupled to one or more memory storage devices (e.g., RAM, Flash ROM, ROM). For example, any desired semiconductor fabrication method may be used to form one or more integrated circuits with a processing system having one or more processors and memory arranged to provide the digital broadcast receiver functional blocks for aligning and blending digital and analog audio signals.

In the illustrated receiver 200, the modem layer 210 receives signal samples 201 containing the analog and digital portions of the received hybrid signal which may optionally be processed by a Sample Rate Conversion (SRC) module 211 for a processing time $T_{SRC}$. Depending on the implementation, the SRC module 211 may or may not be present, but when included, the processing time $T_{SRC}$ is a constant time for that particular implementation. The digital signal samples are then processed by a front-end module 212 which filters and dispenses the digital symbols to generate a baseband signal 202. In selected example embodiments, the front-end module 212 may implement an FM front-end module which includes an isolation filter 213, a first adjacent canceller 214, and a symbol dispenser 215, depending on the implementation. In other embodiments, the front-end module 212 may implement an FM front-end module which includes only the symbol dispenser 215, but not the isolation filter 213 or first adjacent canceller 214. In an example FM front-end module 212, the digital signal samples are processed by the isolation filter 213 during processing time $T_{ISO}$ to filter and isolate the digital audio broadcasting (DAB) upper and lower sidebands. Next, the signal may be passed through an optional first adjacent canceller 214 during a processing time $T_{FAC}$ in order to attenuate signals from adjacent FM signal bands that might interfere with the signal of interest. Finally, attenuated FM signal (or AM signal) enters the symbol dispenser 215 which accumulates samples (e.g., with a RAM buffer) during a processing time $T_{SYM}$. From the symbol dispenser 215, baseband signals 202 are generated. Depending on the implementation, the isolation filter 213, the first adjacent canceller 214, and/or the symbol dispenser 215 may or may not be present, but when included, the corresponding processing time is constant for that particular implementation.

With FM receivers, an acquisition module 216 processes the digital samples from the front end module 212 during processing time $T_{ACQ}$ to acquire or recover OFDM symbol timing offset or error and carrier frequency offset or error from received OFDM symbols. When the acquisition module 216 indicates that it has acquired the digital signal, it adjusts the location of a sample pointer in the symbol dispenser 215 based on the acquisition time with an acquisition symbol offset feedback signal. The symbol dispenser 215 then calls the demodulation module 217.

The demodulation module 217 processes the digital samples from the front end module 212 during a processing time $T_{DEMOD}$ to demodulate the signal and present the demodulated data 219 for decoding to the application layer 220 for upper layer processing, where the total time application layer processing time $T_{Application}=T_{L2}+T_{L4}+T_{Quality}+T_{Blend}+T_{Delay}+T_{BW}$. Depending on whether AM or FM demodulation is performed, the demodulation module 217 performs deinterleaving, code combining, FEC decoding, and error flagging of the received compressed audio data. In addition, the demodulation module 217 periodically determines and outputs a signal quality measure 218. In selected embodiments, the signal quality measure 218 is computed as signal-to-noise ratio values (CD/No) over time that are stored in a memory or storage buffer 230 for use as look ahead metrics 231-234 in guiding the blend decision.

As seen from the foregoing, the total processing time at the modem layer 210 is $T_{MODEM}=T_{FE}+T_{DEMOD}$, where $T_{FE}=T_{SRC}+T_{ISO}+T_{FAC}+T_{SYM}$. Since the processing time for the front end module $T_{FE}$ is constant, there is a negligibly small difference between the time a signal sample is received at the antenna and the time that signal sample is presented to the demodulation module 217.

In the application layer 220, the audio and data signals from the demodulated baseband signal 219 are demultiplexed and audio transport decoding is performed. In particular, the demodulated baseband signal 219 is passed to the L2 data layer module 221 which performs Layer 2 data layer decoding during the data layer processing time $T_{L2}$. In addition, the L2 module 221 may generate Layer 2 signal quality (L2Q) information 227 that is fed forward to the bandwidth management module 226 as an upper layer signal metric that is used to manage the digital audio bandwidth. The time spent in L2 module 221 will be constant in terms of audio frames and will be dependent on the service mode and band. The L2-decoded signal is then passed to the L4 audio decoding layer 222 which performs audio transport and decoding during the audio layer processing time $T_{L4}$. The time spent in L4 audio decoding module 222 will be constant in terms of audio frames and will be dependent on the service mode and band.

The L4-decoded signal is then passed to the quality module 223 which implements a quality adjustment algorithm during processing time $T_{Quality}$ for purposes of empowering the blend decision to lower the signal quality if the previously calculated signal quality measures indicate that the signal will be degrading. In addition, the output from the quality module 223 may be fed forward as audio quality (AQ) signal information 228 to the bandwidth management module 226 to provide an upper layer signal metric that is used to manage the digital audio bandwidth. The time spent in quality module 223 will be constant in terms of audio frames and will be dependent on the service mode and band.

The decoded output from the quality module 223 is provided to the blend decision module 224 which processes the received signal during processing time $T_{Blend}$ for purposes of deciding whether to stay in a digital or analog mode or to start digitally combining the analog audio frames with the realigned digital audio frames. In addition, the blend module 224 may generate blend status signal information 229 that is fed forward to the bandwidth management module 226 as an upper layer signal metric that is used to manage the digital audio bandwidth. The time spent in blend decision module 224 will be constant in terms of audio frames and will be dependent on the service mode and band. The blend decision module 224 decides whether to blend to digital or analog in response to the audio quality (AQ) signal information 228 for controlling the audio frame combination in terms of the relative amounts of the analog and digital portions of the signal that are used to form the output. As described hereinbelow, the selected blending algorithm output may be implemented by a separate audio transition module (not shown), subject to bandwidth management control signaling provided by the bandwidth management module 226.

The decoded output from the blend module 224 is provided to the buffer 225 which processes the received signal during processing time $T_{Delay}$ for purposes of delaying and aligning the decoded digital signal to blend smoothly with the decoded analog signal. While the size of the buffer 225 may be variable in order to store decoded digital signals from a predetermined number of digital audio frames (e.g., 20 audio frames), the time spent in the delay buffer 225 will be constant in terms of audio frames, and will also depend on the service mode and band. For example, if a sample reaches the demodulator module 217 at time "T," it will take a constant time (in terms for audio frames where each audio frame is 46 ms in duration) for each mode (FM—MP1-MP3, MP5, MP6, MP11 and AM—MA1, MA3) to present itself to the bandwidth management module 226, so the delay buffer 225 is used to delay delivery of the decoded signal to the bandwidth management module 226.

At the bandwidth management module 226, look ahead metrics and/or upper layer signal metric information extracted from the digital signal are processed to adaptively control the digital audio bandwidth that is used when blending the analog audio frames with the realigned digital audio frames. In selected embodiments, the look ahead metrics are previously-computed signal quality measure CD/No value(s) 231-234 that the bandwidth management module 226 retrieves from the buffer 230. In addition, the bandwidth management module 226 may receive one or more upper layer signal metrics 227-229 that are computed by the L2 module 221, quality module 223, and blend module 224. The bandwidth management module 226 processes the look ahead metrics and/or upper layer signal metric information during processing time $T_{BW}$ to control the digital signal bandwidth used to combine the analog audio frames with the realigned digital audio frames based on signal strength of the digital signal in upcoming or "future" audio frames. The time $T_{BW}$ spent in bandwidth management module 226 will be constant in terms of audio frames and will be dependent on the service mode and band.

In cases where the look ahead signal metrics or upper layer signal metrics indicate that the upcoming digital audio samples are degrading or below a quality threshold measure, the bandwidth management module 226 reduces the bandwidth of the decoded digital signal 203. The digital audio bandwidth should be reduced slowly to a minimum as signal conditions degrade, and if signal conditions require, the stereo audio signal should be slowly reduced to the mono component so that, during the blend operation, the perceptual differences during blending are not noticeable. In this way, large bandwidth transitions (e.g., from 15 kHz to 4 kHz or lower in AM, or from 20 kHz to 15 kHz in FM) are avoided when the digital signal is lost. In cases where the look ahead signal metrics or upper layer signal metrics indicate that the upcoming digital audio signal quality is improving or above a quality threshold measure, the bandwidth management module 226 may slowly increase the bandwidth of the decoded digital signal 203. In addition, the audio signal should transition from mono to stereo to bring out the higher fidelity. This expansion should not be abrupt, but should transition slowly using predetermined or adjustable step increments. In cases where the receiver blends from analog to digital at the initial acquisition of an IBOC signal or reemergence of the digital signal after the presence of interference (due to GCS or AWGN or any other conditions), the bandwidth management module 226 may set the bandwidth of the decoded digital signal 203 to be audibly compatible with the existing analog signal bandwidth. In this way, the bandwidth management module 226 prevents disruptive bandwidth changes (e.g., from 4 kHz or lower to 15 kHz in AM, or from 15 kHz to 20 kHz in FM) which sound like the audio level has been increased suddenly.

As disclosed herein, any desired evaluation algorithm may be used to evaluate the digital signal quality measures to determine the quality of the upcoming digital audio samples. For example, a signal quality threshold value (e.g., $Cd/No_{min}$) may define a minimum digital signal quality measure that must be met on a plurality of consecutive audio frames to allow increases in the digital signal bandwidth. In addition or in the alternative, a threshold count may establish a trigger for reducing the digital signal bandwidth if the number of consecutive audio frames failing to meet the signal quality threshold value meets or exceeds the threshold count. In addition or in the alternative, a "running average" or "majority voting" quantitative decision may be applied to all digital signal quality measures stored in the buffer 230 to manage the digital signal bandwidth.

The ability to use previously-computed signal quality measures exists because the receiver system is deterministic in nature, so there is a defined constant time delay (in terms of audio frames) between the time when a sample reaches the demodulation module 217 and the time when the bandwidth decision is made at bandwidth management module 226. As a result, the calculated signal quality measure value (CD/No) for a sample that is stored in the memory/storage buffer 230 during signal acquisition may be used to provide the bandwidth management module 226 with advanced or a priori knowledge of when the digital signal quality is improving or degrading. By computing and storing the system delay for a given mode (e.g., FM—MP1-MP3, MP5, MP6, MP11 and AM—MA1, MA3), the signal quality measure CD/No value(s) 231-234 stored in the memory/storage buffer 230 may be used by the bandwidth management module 226 after the time delay required for the sample to reach the bandwidth management module 226. This is possible because the processing time delay ($T_{L2}+T_{L4}+T_{Quality}+T_{Blend}+T_{Delay}$) between the demodulation module 217 and bandwidth management module 226 means that the bandwidth management module 226 is processing older samples (e.g., CD/No(T−N)), but has access to "future" samples (e.g., CD/No(T), CD/No (T−1), CD/No(T−2), etc.) from the memory/storage buffer 230. In this way, the bandwidth management module 226 may prevent the receiver from abruptly expanding the audio bandwidth when blending from a low bandwidth audio signal (e.g., analog audio signal) to a high bandwidth audio signal (e.g., digital IBOC signal), thereby reducing unpleasant disruptions in the listening experience. In similar fashion, if the stored signal quality values (e.g., 231-234) indicate that the received digital signal is degrading, the bandwidth management module 226 may slowly reduce the digital signal bandwidth as the digital signal degrades. In this way, the stored signal quality values (e.g., 231-234) provide look ahead metrics to smooth the blend transitions to provide a better user experience.

Figure 3:
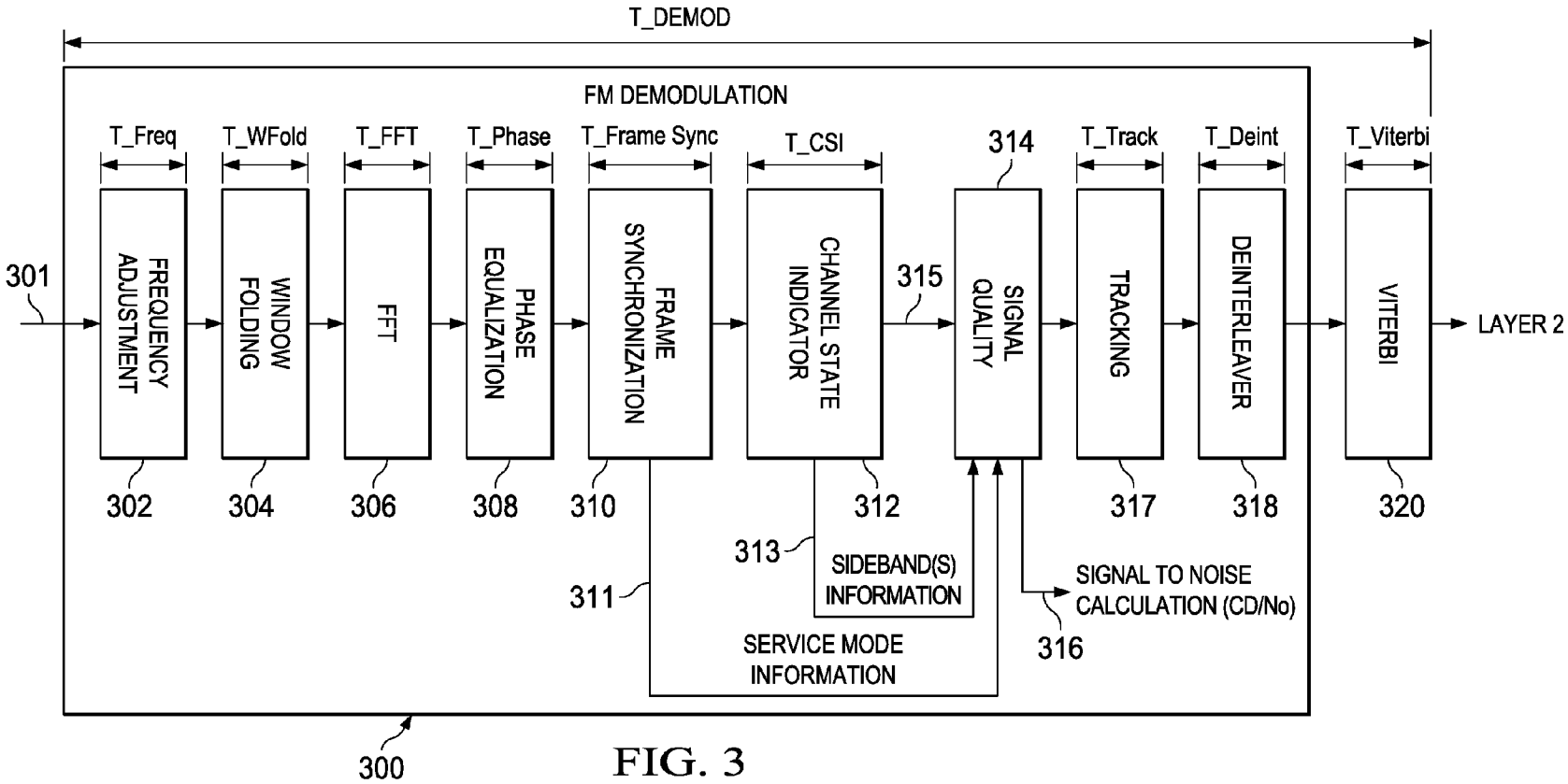
FIG. 3 illustrates a simplified timing block diagram of an exemplary FM demodulation module for calculating predetermined signal quality information for use in aligning and blending digital and analog audio FM signals in accordance with selected embodiments.

An exemplary FM demodulation module 300 is illustrated in FIG. 3 which shows a simplified timing block diagram of the FM demodulation module components for calculating predetermined signal quality information for use in aligning and blending digital and analog audio FM signals in accordance with selected embodiments. As illustrated, the received baseband signals 301 are processed by the frequency adjustment module 302 (over processing time $T_{Freq}$) to adjust the signal frequency. The resulting signal is processed by the window/folding module 304 (over processing time $T_{Wfold}$) to window and fold the appropriate symbol samples, and is then sequentially processed by the fast Fourier transform (FFT) module 306 (over processing time $T_{FFT}$), the phase equalization module 308 (over processing time $T_{Phase}$), and the frame synchronization module 310 (over processing time $T_{FameSync}$) to transform, equalize and synchronize the signal for input to the channel state indicator module 312 for processing (over processing time $T_{CSI}$) to generate channel state information 315.

The channel state information 315 is processed by the signal quality module 314 along with service mode information 311 (provided by the frame synchronization module 310) and sideband information 313 (provided by the channel state indicator module 312) to calculate signal quality values 316 (e.g., SNR CD/No sample values) over time. In selected embodiments, each Cd/No value is calculated at the signal quality module 314 based on the signal-to-noise ratio (SNR) value of equalized upper and lower primary sidebands 313 provided by the CSI module 312. The SNR may be calculated by summing up $I^2$ and $Q^2$ from each individual upper and lower primary bins. Alternatively, the SNR may be calculated by separately computing SNR values from the upper sideband and lower sideband, respectively, and then selecting the stronger SNR value. In addition, the signal quality module 314 may use primary service mode information 311 extracted from system control data in frame synchronization module 310 to calculate different Cd/No values for different modes. For example, the CD/No sample values may be calculated as Cd/No_FM=10*log 10(SNR/360)2+C, where the value of "C" depends on the mode. Based on the inputs, the signal quality module 314 generates channel state information output signal values for the symbol tracking module 317 where they are processed (over processing time $T_{Track}$) and then forwarded for deinterleaving at the deinterleaver module 318 (over processing time $T_{Deint}$) to produce soft decision bits. A Viterbi decoder 320 processes the soft decision bits to produce decoded program data units on the Layer 2 output line.

Figure 4:
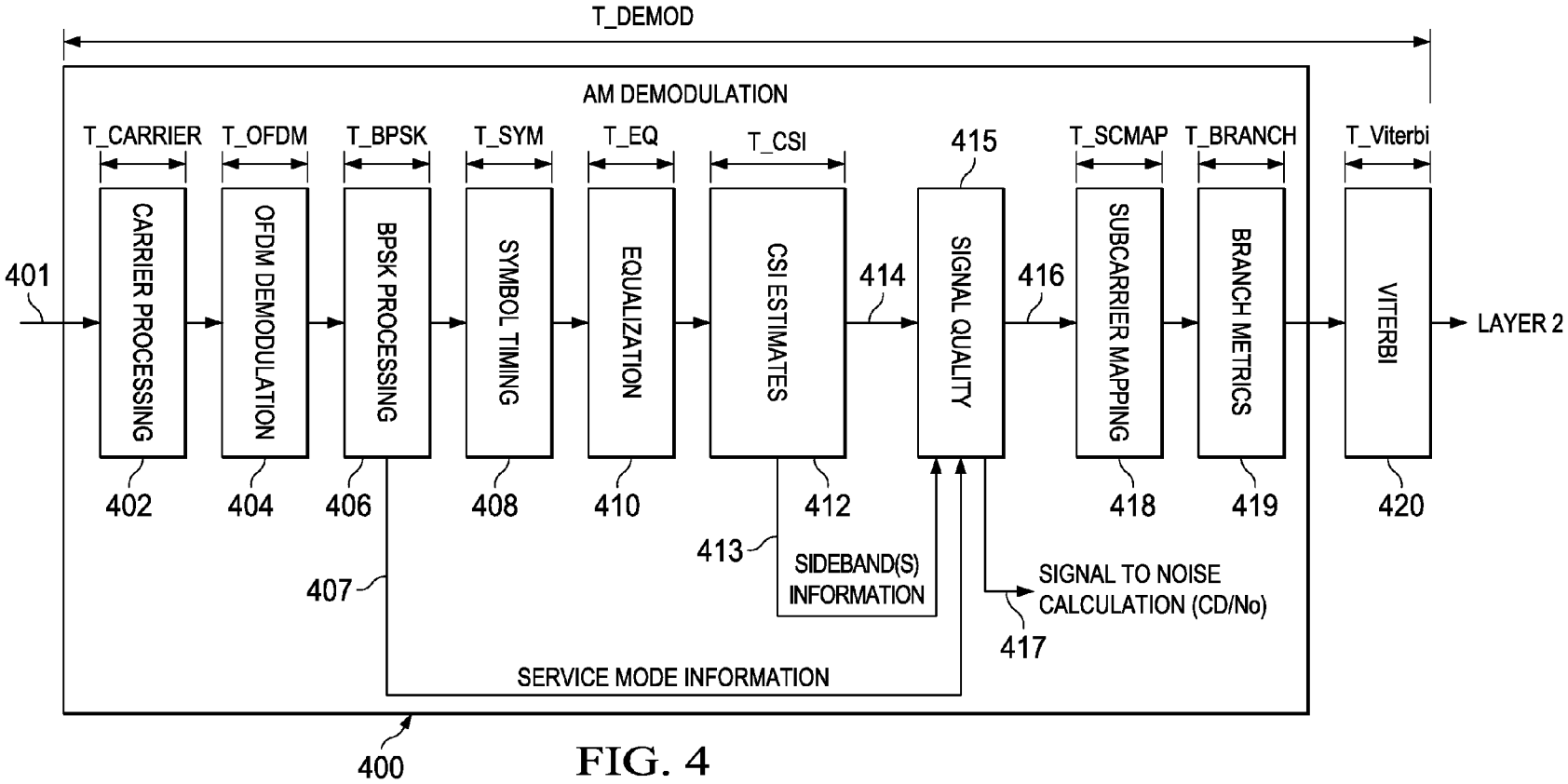
FIG. 4 illustrates a simplified timing block diagram of an exemplary AM demodulation module for calculating predetermined signal quality information for use in aligning and blending digital and analog audio AM signals in accordance with selected embodiments.

An exemplary AM demodulation module 400 is illustrated in FIG. 4 which shows a simplified timing block diagram of the AM demodulation module components for calculating predetermined signal quality information for use in aligning and blending digital and analog audio AM signals in accordance with selected embodiments. As illustrated, the received baseband signals 401 are processed by the carrier processing module 402 (over processing time $T_{Carrier}$) to generate a stream of time domain samples. The resulting signal is processed by the OFDM demodulation module 404 (over processing time $T_{OFDM}$) to produce frequency domain symbol vectors which are processed by the binary phase shift key (BPSK) processing module 406 (over processing time $T_{BPSK}$) to generate BPSK values. At the symbol timing module 408, the BPSK values are processed (over processing time $T_{SYM}$) to derive symbol timing error values. The equalizer module 410 processes the frequency domain symbol vectors in combination with the BPSK and carrier signals (over processing time $T_{EQ}$) to produce equalized signals for input to the channel state indicator estimator module 412 for processing (over processing time $T_{CSI}$) to generate channel state information 414.

The channel state information 414 is processed by the signal quality module 415 along with service mode information 407 (provided by the BPSK Processing module 406) and sideband information 413 (provided by the CSI estimator module 412) to calculate signal quality values 417 (e.g., SNR CD/No sample values) over time. In selected embodiments, each Cd/No value is calculated at the signal quality module 415 based on equalized upper and lower primary sidebands 413 provided by the CSI estimation module 412. The SNR may be calculated by summing up $I^2$ and $Q^2$ from each individual upper and lower primary bins. Alternatively, the SNR may be calculated by separately computing SNR values from the upper sideband and lower sideband, respectively, and then selecting the stronger SNR value. In addition, the signal quality module 415 may use the primary service mode information 407 which is extracted by the BPSK processing module 406 to calculate different Cd/No values for different modes. For example, the CD/No sample values may be calculated as Cd/No_AM=10*log 10((800/SNR)*4306.75)+C, where the value of "C" depends on the mode. The signal quality module 415 also generates CSI output signal values 416 for the subcarrier mapping module 418 where the signals are mapped (over processing time $T_{SCMAP}$) to subcarriers. The subcarrier signals are then processed by the branch metrics module 419 (over processing time $T_{BRANCH}$) to produce branch metrics that are forwarded to the Viterbi decoder 420 which processes the soft decision bits (over processing time $T_{Viterbi}$) to produce decoded program data units on the Layer 2 output line.

As indicated above, the demodulator module calculates predetermined signal quality information for every mode for storage and retrieval by the bandwidth management module to manage the digital audio bandwidth. While any desired signal quality computation may be used, in selected embodiments, the signal quality information may be computed as a signal to noise ratio (CD/No) for use in guiding FM blending decisions using the equation Cd/No_FM=10*log 10(SNR/360)/2+C, where "SNR" is the SNR of equalized upper and lower primary sidebands 313 received from the CSI module 312, and where "C" has a specific value for each FM IBOC mode (e.g., C=51.4 for MP1, C=51.8 for MP2, C=52.2 for MP3, and C=52.9 for MP5, MP6, MP11). Similarly, the signal quality information may be computed as a signal to noise ratio (CD/No) for use in guiding AM blending decisions using the equation Cd/No_AM=10*log 10((800/SNR)*4306.75)+C, where "SNR" is the SNR of equalized upper and lower primary sidebands 413 received from the CSI estimation module 412, and where "C" has a specific value for each AM IBOC mode (e.g., C=30 for MA1 and C=15 for MA3). In other embodiments, the SNR may be calculated separately for the upper sideband and lower sidebands, followed by application of a selection method, such as selecting the stronger SNR value.

Figure 5:
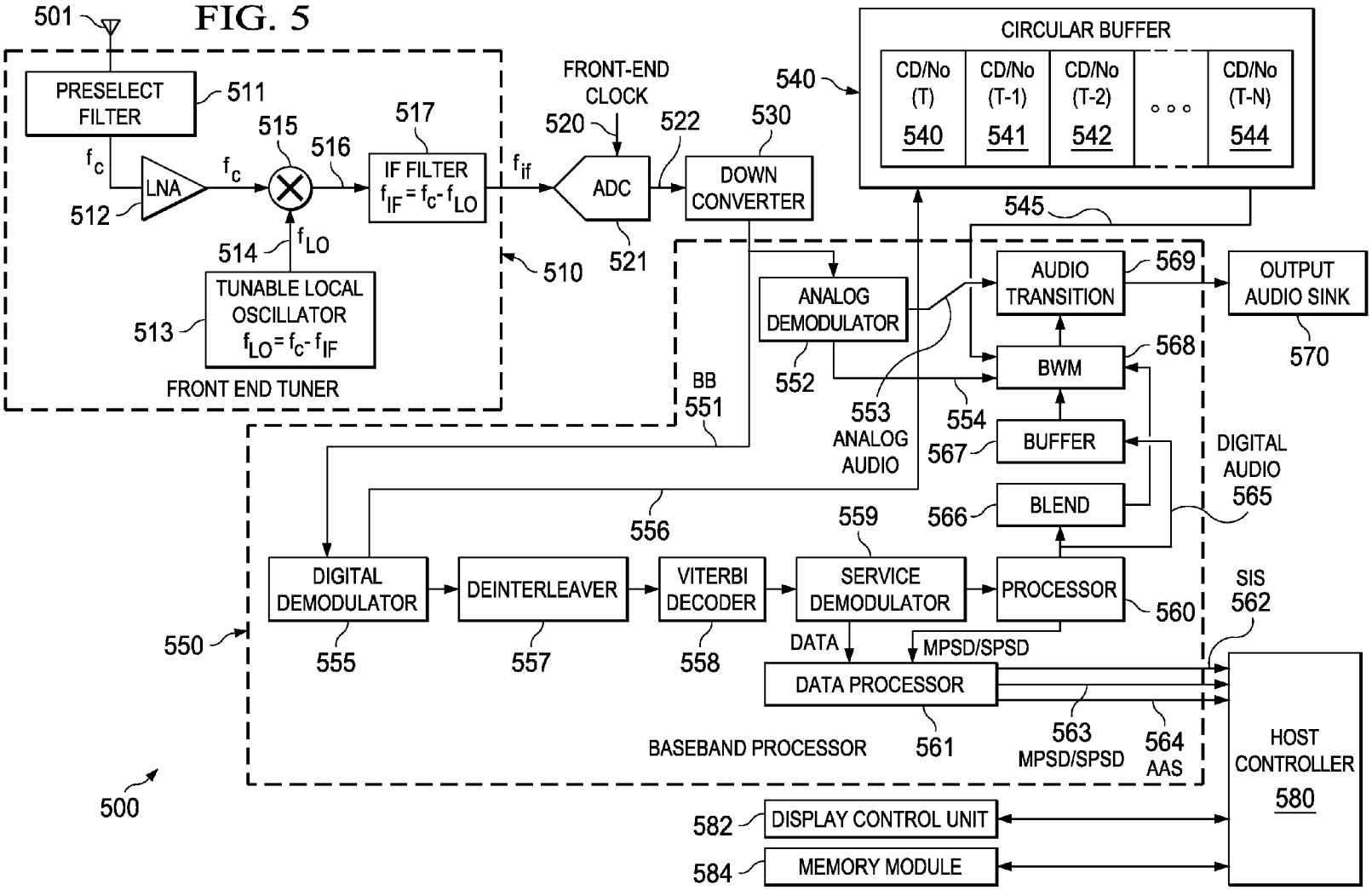
FIG. 5 illustrates a simplified block diagram of an exemplary digital radio broadcast receiver using predetermined signal quality information to adaptively manage signal bandwidth during blending of analog and digital signals in accordance with selected embodiments.

To further illustrate selected embodiments of the present invention, reference is now made to FIG. 5 which illustrates a simplified block diagram of an exemplary IBOC digital radio broadcast receiver 500 (such as an AM or FM IBOC receiver) which uses predetermined signal quality information to adaptively manage signal bandwidth during blending of analog and digital signals in accordance with selected embodiments. While only certain components of the receiver 500 are shown for exemplary purposes, it should be apparent that the receiver 500 may include additional or fewer components and may be distributed among a number of separate enclosures having tuners and front-ends, speakers, remote controls, various input/output devices, etc. In addition, many or all of the signal processing functions shown in the digital radio broadcast receiver 500 can be implemented using one or more integrated circuits.

The depicted receiver 500 includes an antenna 501 connected to a front-end tuner 510, where antenna 501 receives composite digital audio broadcast signals. In the front end tuner 510, a bandpass preselect filter 511 passes the frequency band of interest, including the desired signal at frequency $f_c$ while rejecting undesired image signals. Low noise amplifier (LNA) 512 amplifies the filtered signal, and the amplified signal is mixed in mixer 515 with a local oscillator signal $f_{lo}$ supplied on line 514 by a tunable local oscillator 513. This creates sum ($f_c+f_{lo}$) and difference ($f_c-f_{lo}$) signals on line 516. Intermediate frequency filter 517 passes the intermediate frequency signal $f_{if}$ and attenuates frequencies outside of the bandwidth of the modulated signal of interest. An analog-to-digital converter (ADC) 521 operates using the front-end clock 520 to produce digital samples on line 522. Digital down converter 530 frequency shifts, filters and decimates the signal to produce lower sample rate in-phase and quadrature baseband signals on lines 551, and may also output a receiver baseband sampling clock signal (not shown) to the baseband processor 550.

At the baseband processor 550, an analog demodulator 552 demodulates the analog modulated portion of the baseband signal 551 to produce an analog audio signal on line 553 for input to the audio transition module 569. In addition, a digital demodulator 555 demodulates the digitally modulated portion of the baseband signal 551. When implementing an AM demodulation function, the digital demodulator 555 directly processes the digitally modulated portion of the baseband signal 551. However, when implementing an FM demodulation function, the digitally modulated portion of the baseband signal 551 is first filtered by an isolation filter (not shown) and then suppressed by a first adjacent canceller (not shown) before being presented to the OFDM digital demodulator 555. In either the AM or FM demodulator embodiments, the digital demodulator 555 periodically determines and stores a signal quality measure 556 in a circular or ring storage buffer 540 for use in controlling the bandwidth settings at the bandwidth management module 568. The signal quality measure may be computed as signal to noise ratio values (CD/No) for each IBOC mode (MP1-MP3, MP5, MP6, MP11, MA1 and MA3) so that a first CD/No value at time (T−N) is stored at 544, and future CD/No values at time (T−2), (T−1) and (T) are subsequently stored at 543, 542, 541 in the circular buffer 540. In support of adaptive bandwidth management, the analog demodulator 552 may provide real time analog signal characteristic information 554 to the bandwidth management module 568 for use in controlling the settings for the bandwidth and loudness for the IBOC demodulated signal. Alternatively, the bandwidth management module 568 may store or retrieve pre-calculated analog signal characteristic values that are computed empirically and used to initialize the digital audio bandwidth and loudness settings.

After processing at the digital demodulator 555, the digital signal is deinterleaved by a deinterleaver 557, and decoded by a Viterbi decoder 558. A service demodulator 559 separates main and supplemental program signals from data signals. A processor 560 processes the program signals to produce a digital audio signal on line 565. At the blend decision module 566, the digital audio signal 565 is processed to generate and control a blend algorithm for blending the analog and main digital audio signals in the audio transition module 569. The blend decision module 566 may also generate blend status information that is fed forward directly to the bandwidth management module 568 along with one or more upper layer signal metrics that are used to manage the digital audio bandwidth. The digital audio signal 565 from the processor 560 is also provided to the alignment delay buffer 567 for purposes of delaying and aligning the decoded digital signal with the decoded analog signal.

At the bandwidth management module 568, look ahead metrics and/or upper layer signal metric information are processed to adaptively control the digital audio bandwidth that is used when blending the analog audio frames with the realigned digital audio frames. In selected embodiments, the look ahead metrics are one or more previously-computed signal quality measure CD/No value(s) 541-544 retrieved 545 from the circular buffer 540. If the previously-stored digital signal quality measures 541-544 indicate that the upcoming audio samples are degraded or below a quality threshold measure, then the bandwidth management module 568 may reduce or shrink the size of the digital audio bandwidth using a predetermined step down function until a minimum digital bandwidth is reached that is suitable for smooth transition to the analog audio bandwidth. In similar fashion, if the stored digital signal quality values (e.g., 541-544) indicate that the received digital signal is improving, the bandwidth management module 568 may increase the size of the digital audio bandwidth using a predetermined step up function to gradually increase the digital audio bandwidth. In other embodiments, a supplemental digital audio signal in all non-hybrid modes is bypassed through the blend processing blocks 566-568 and audio transition module 569 for the output audio sink 570.

A data processor 561 processes the data signals from the service demodulator 560 to produce data output signals on data lines 562-564 which may be multiplexed together onto a suitable bus such as an inter-integrated circuit ($I^2C$), serial peripheral interface (SPI), universal asynchronous receiver/transmitter (UART), or universal serial bus (USB). The data signals can include, for example, SIS signal 562, MPS or SPS data signal 563, and one or more AAS signals 564.

The host controller 580 receives and processes the data signals 562-564 (e.g., the SIS, MPSD, SPSD, and AAS signals) with a microcontroller or other processing functionality that is coupled to the display control unit (DCU) 582 and memory module 584. Any suitable microcontroller could be used such as an Atmel® AVR 8-bit reduced instruction set computer (RISC) microcontroller, an advanced RISC machine (ARM®) 32-bit microcontroller or any other suitable microcontroller. Additionally, a portion or all of the functions of the host controller 580 could be performed in a baseband processor (e.g., the processor 565 and/or data processor 561). The DCU 582 comprises any suitable I/O processor that controls the display, which may be any suitable visual display such as an LCD or LED display. In certain embodiments, the DCU 582 may also control user input components via touch-screen display. In certain embodiments the host controller 580 may also control user input from a keyboard, dials, knobs or other suitable inputs. The memory module 584 may include any suitable data storage medium such as RAM, Flash ROM (e.g., an SD memory card), and/or a hard disk drive. In certain embodiments, the memory module 584 may be included in an external component that communicates with the host controller 580, such as a remote control.

Referring back to the blend decision module 566, one of the challenges presented with blending is the blend transition time between the analog and digital audio outputs is relatively short (e.g., generally less than one second). And frequent transitions between the analog and digital audio can be annoying when there is a significant difference in audio quality between the wider audio bandwidth digital audio and the narrower audio bandwidth analog. To address this problem, the blend decision module 566 may statically control the blend function to prevent short bursts of digital audio while maintaining the analog signal output, but this approach can degrade the analog audio quality and also negates the potential advantages of the diversity delay. Another solution is for the blend decision module 566 to dynamically control the stereo separation and bandwidth of the digital signal during these events such that the digital audio is better matched to the analog audio in stereo separation and bandwidth, thereby mitigating the annoying transitions while filling in the degraded analog with a better digital audio signal.

To further illustrate selected embodiments for dynamically controlling the blending of analog and digital audio signals, reference is now made to FIG. 6 which illustrates an exemplary process 600 for adjusting the stereo separation of an audio stream while blending audio samples of a digital portion of a radio broadcast signal with audio samples of an analog portion of the radio broadcast signal. The stereo separation process may be implemented in the bandwidth management module which receives the PCM audio from the alignment delay buffer at step 632 (such as the delay buffer 225 shown in FIG. 2). At step 634, the bandwidth management module implements a stereo separation process 601-630 to compute current stereo separation parameters that are used to adjust the stereo separation of the audio stream. At step 636, the audio samples with adjusted stereo separation are sent to the audio bandwidth control block where the bandwidth of the digital signal can be controlled.

After the stereo separation process starts at step 601, a new audio frame is received and demodulated at the receiver (step 602). As the frame is demodulated, signal quality information is extracted to determine the digital signal quality for use as a look ahead metric. At this point, the digital signal quality for the frame may be computed in the digital signal path as a signal to noise ratio value (CD/No) for each IBOC mode (e.g., MP1-MP3, MP5, MP6, MP11, MA1 and MA3), and then stored in memory (e.g., a ring buffer), thereby updating the look ahead metrics. Of course, additional IBOC modes can be added in the future. In addition to extracting signal quality information from the digital signal path, analog signal characteristic information (e.g., signal pitch, loudness, and bandwidth) for the frame may be computed in the analog signal path for use in controlling or managing the bandwidth and/or loudness settings for the digital signal path.

At step 604, the blend decision algorithm processes the received audio frame to select a blend status for use in digitally combining the analog portion and digital portion of the audio frame. The selected blend status is used by the audio transition process (not shown) which performs audio frame combination by blending relative amounts of the analog and digital portions to form the audio output. To this end, the blend decision algorithm may propose an "analog" blend status or a "digital" blend status so that, depending on the current blend status, an "analog to digital" or "digital to analog" transition results. If an "analog" blend status is detected ("analog" output from detection step 604), the bandwidth and timer values for the digital audio are initialized at step 606 by setting a "current bandwidth" parameter for the digital audio to a starting default bandwidth value and setting the bandwidth timer for the digital audio to zero. However, when a "digital" blend status is detected ("digital" output from detection step 604), the receiver settings are checked at step 608 to see if "stereo" mode is permitted.

Figure 7:
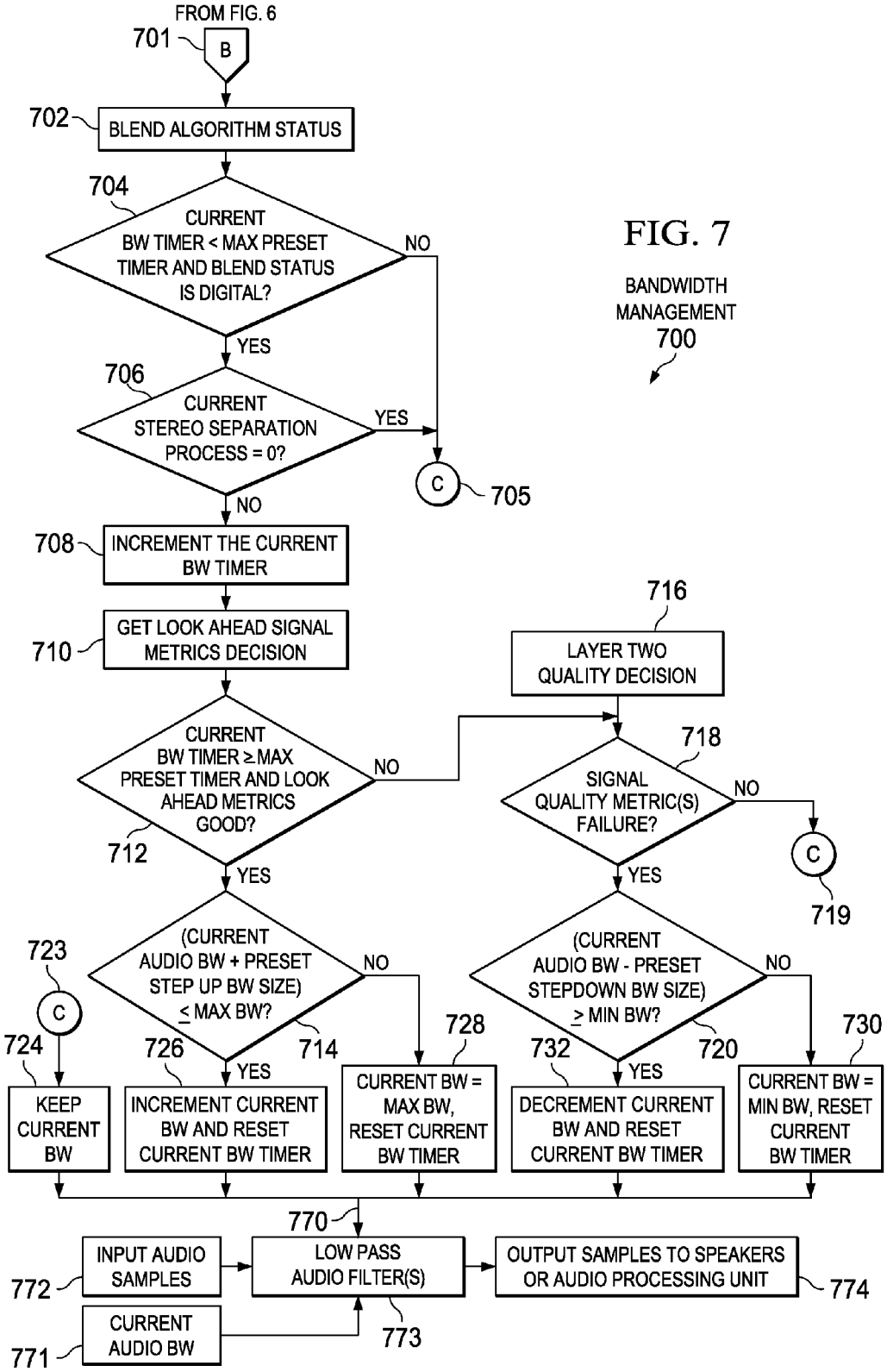
FIG. 7 illustrates an exemplary processes for adaptively managing signal bandwidth by selectively incrementing and decrementing the audio bandwidth while blending audio samples of a digital portion of a radio broadcast signal with audio samples of an analog portion of the radio broadcast signal.

If transitions to stereo are not enabled (negative outcome from detection step 608), then the receiver may proceed via 609 to the bandwidth management process shown in FIG. 7. However, if transitions to stereo are enabled (affirmative outcome from detection step 608), then the receiver settings are checked at step 610 to determine if the current digital bandwidth exceeds the stereo bandwidth threshold for transitioning the audio signal from "mono" to "stereo" to bring out the higher fidelity. If the stereo bandwidth threshold requirement is not met (negative outcome from detection step 610), then one or more stereo separation parameters for the digital audio are set at step 612 to predetermined values corresponding to the "mono" mode. For example, the stereo separation parameters may include a "Current BW Stereo" parameter that is a flag set to a first value (e.g., "0") at step 612 to indicate that the receiver mode is "mono." In addition, a "Current Stereo Separation" parameter may be set as a value (e.g., "0") at step 612 to indicate the extent of stereo separation. In selected embodiments, the value of the "Current Stereo Separation" parameter may range from a first value (e.g., "0" indicating full mono) to a second value (e.g., "1" indicating full stereo), with any intermediate value indicating reduced stereo separation. There may also be a "Current Stereo Separation Count" parameter set that may be set as a value at step 612 to indicate how many audio frames must have good signal quality before incrementing the "Current Stereo Separation" parameter by a predetermined increment amount. In this example, if the "Current Stereo Separation Count" parameter has a value "0," this indicates that there is no incrementing of the stereo separation in the "mono" mode. Finally, the stereo separation parameters may include a "Stereo Separation Process" parameter that is a flag set to a first value (e.g., "0") at step 612 to indicate that receiver mode is in "mono" mode so that the stereo separation process is not enabled.

Once the current digital bandwidth exceeds the stereo bandwidth threshold (affirmative outcome from detection step 610), the receiver determines if the receiver is currently in "mono" mode, such as by detecting whether the "Current BW Stereo" parameter is set to "0" at step 614. If the receiver is in "mono" mode (affirmative outcome from detection step 614), then selected stereo separation parameters for the digital audio are set at step 616 to values corresponding to the "mono" mode. For example, the "Current Stereo Separation" parameter may be set to "0" at step 616 to indicate that there is no stereo separation in the "mono" mode. In addition, the "Current Stereo Separation Count" parameter may be set to "0" at step 616 to indicate the there is no incrementing of the stereo separation in the "mono" mode. Finally, a "Stereo Separation Process" parameter may be set to zero at step 616 to indicate that no stereo separation process applies in the "mono" mode.

On the other hand, if detection step 614 indicates that the receiver is currently in "stereo" mode (negative outcome from detection step 614), then selected stereo separation parameters for the digital audio are set at step 618 to initial values corresponding to the initial transition to "stereo" mode. For example, the "Current BW Stereo" parameter is set to a second value (e.g., "1") at step 618 to change the receiver mode to "stereo." In addition, the "Stereo Separation Process" parameter may be set to a second value (e.g., "1") at step 618 to indicate that the stereo separation process is enabled in the "stereo" mode.

After the stereo separation parameters for the digital audio are initialized at step 618 for an initial "stereo" mode, the receiver determines at step 620 whether the current stereo separation count equals the preset mono-to-stereo separation count. If the required number of audio frames having a good signal quality has not been met (negative outcome from detection step 620), then the current stereo separation count is incremented at step 622, and the process proceeds via 623 to receive the next audio frame at step 602. On the other hand, if the current stereo separation count meets the preset mono-to-stereo separation count requirement (affirmative outcome to detection step 620), then the receiver determines at step 624 whether incrementing the current stereo separation parameter would meet or exceed the maximum preset mono-to-stereo separation value.

At this point in the stereo separation process, the current stereo separation count requirement has been met, so the current stereo separation parameter may be incremented by an increment value, provided it does not exceed a maximum preset mono-to-stereo separation value. If the incremented current stereo separation parameter would exceed the preset mono-to-stereo separation value (negative outcome to detection step 624), then at step 626, the current stereo separation is maxed out by setting the current stereo separation parameter to the preset mono-to-stereo separation value, and the stereo separation process parameter is reset to zero. However, if the incremented current stereo separation parameter would be less than or equal to the preset mono-to-stereo separation value (affirmative outcome to detection step 624), then the current stereo separation parameter is incremented by the increment value at step 628. After steps 626 and 628, the current stereo separation count parameter is set to "0" at step 630 to restart the audio frame count.

To further illustrate selected embodiments for dynamically controlling the blending of analog and digital audio signals, reference is now made to FIG. 7 which illustrates an exemplary bandwidth management module 700 for using look ahead metrics to dynamically manage the digital audio signal bandwidth by selectively incrementing and decrementing the audio bandwidth such that, when blending audio samples of a digital portion of a radio broadcast signal with audio samples of an analog portion of the radio broadcast signal, the perceptual differences are not noticeable. The bandwidth management module 700 may be implemented with one or more low pass audio filters 773 which receive and process input audio samples 772 based on the current audio bandwidth control input signal 771 and one or more bandwidth control signals 770, and generate therefrom output samples which are provided to the speakers or audio processing unit 774. The depicted bandwidth control signals 770 are generated by the bandwidth adjustment process 701-732 to increase or decrease the bandwidth using defined step sizes based on the look ahead signal metrics and upper layer quality indicators. As will be appreciated, the implementation of the low pass audio filter(s) 773 will depend on the processor speed and memory constraints.

After the bandwidth adjustment process starts at step 701, the blend algorithm processes the received audio frame at step 702 to select a blend status for use in digitally combining the analog portion and digital portion of the audio frame. The selected blend status is used by the audio transition process (not shown) which performs audio frame combination by blending relative amounts of the analog and digital portions to form the audio output. To this end, the blend algorithm may propose an "analog" blend status or a "digital" blend status.

At step 704, the receiver checks the current bandwidth timer and blend status. If an "analog" blend status is detected or the current bandwidth timer has reached the maximum preset timer value (negative output from detection step 704), then no bandwidth adjustment is required and the process proceeds via 705, 723 to generate a bandwidth control signal 770 at step 724 which instructs the low pass filter(s) 773 to keep the current bandwidth. However, if a "digital" blend status is detected and the current bandwidth timer has not reached the maximum preset timer value (affirmative output from detection step 704), then the bandwidth adjustment process detects at step 706 whether the receiver is in "mono" mode, such as by detecting whether the stereo separation process parameter is set to a "mono" setting (e.g., "0").

If the receiver is set to "mono" mode (e.g., affirmative output from detection step 706), the process proceeds via 705, 723 to generate a bandwidth control signal 770 at step 724 which instructs the low pass filter(s) 773 to keep the current bandwidth. However, if the current stereo separation setting is not zero (negative output from detection step 746), this indicates that the current stereo separation permits a bandwidth adjustment, and the current bandwidth timer is incremented at step 708 by a defined timer increment amount. In an example embodiment the timer increment amount corresponds to the duration of an audio frame (e.g., 46 ms), though other timer increment amounts may be used. After incrementing the current bandwidth timer, the look ahead signal metrics are evaluated at step 710 to determine the quality of the upcoming audio frames. In selected embodiments, one or more previously-computed look ahead metrics are evaluated at step 710 to determine if the digital signal quality of upcoming audio frames is good. The evaluation step 710 may retrieve previously-computed Cd/No values on consecutive audio frames from memory and compare them with a threshold value. As disclosed herein, any desired evaluation algorithm may be used to evaluate the digital signal quality measures to determine the quality of the upcoming digital audio samples. For example, a signal quality threshold value (e.g., $Cd/No_{min}$) may define a minimum digital signal quality measure that must be met on a plurality of consecutive audio frames to allow increases in the digital signal bandwidth. In addition or in the alternative, a threshold count may establish a trigger for increasing the digital signal bandwidth if the number of consecutive audio frames meeting the signal quality threshold value meets or exceeds the threshold count. In addition or in the alternative, a "running average" or "majority voting" quantitative decision may be applied to all digital signal quality measures. As will be appreciated, any other desired quantitative decision comparison algorithm may be used at step 710.

If the look ahead metrics for the upcoming audio frames look good and the current bandwidth timer meets or exceeds the maximum preset timer value (affirmative outcome to decision 712), this indicates that conditions are suitable for expanding or increasing the digital audio bandwidth, provided that the current digital audio bandwidth is not already maxed out. This is evaluated at step 714 which detects whether the maximum preset bandwidth would be exceeded by incrementing the current digital audio bandwidth by a preset bandwidth step-up value. If the incremented bandwidth would not exceed the maximum permitted bandwidth (affirmative outcome to detection step 714), the current bandwidth is incremented by the preset bandwidth step-up value and the current timer is reset at step 726, thereby generating a bandwidth control signal 770 at step 726 which instructs the low pass filter(s) 773 to increase the digital audio bandwidth. However, if the incremented bandwidth would exceed the maximum permitted bandwidth (negative outcome to detection step 714), then the current bandwidth is set to the maximum preset bandwidth and the current timer is reset at step 728, thereby generating a bandwidth control signal 770 at step 728 which instructs the low pass filter(s) 773 to increase the digital audio bandwidth to the maximum preset bandwidth.

A similar process is used to reduce or shrink the current bandwidth if the signal conditions are deteriorating, as indicated by the negative outcome from decision 712. In this case, one or more upper layer quality indicators may be retrieved at step 716, including but limited to Layer 2 signal quality (L2Q) information provided by the upper layer L2 decoding module. In addition or in the alternative, audio quality (AQ) signal information may be received from the output from the quality module.

At step 718, the signal quality metrics are evaluated to determine if the signal conditions are deteriorating over time. The signal quality metrics evaluated at step 718 may include one or more previously-computed look ahead metrics which indicate if the digital signal quality of upcoming audio frames is bad. The evaluation step 718 may retrieve previously-computed Cd/No values on consecutive audio frames from memory and compare them with a threshold value. As disclosed herein, any desired evaluation algorithm may be used to evaluate the digital signal quality measures to determine the quality of the upcoming digital audio samples. For example, a signal quality threshold value (e.g., $Cd/No_{min}$) may define a minimum digital signal quality measure that, if not met on a plurality of consecutive audio frames, will permit the digital signal bandwidth to be reduced. In addition or in the alternative, a threshold count may establish a trigger for reducing the digital signal bandwidth if the number of consecutive audio frames failing to meet the signal quality threshold value meets or exceeds the threshold count. In addition or in the alternative, a "running average" or "majority voting" quantitative decision may be applied to all digital signal quality measures to manage the digital signal bandwidth. As will be appreciated, any other desired quantitative decision comparison algorithm may be used at step 718.

In addition or in the alternative, one or more upper layer quality indicators may be evaluated at step 718 to determine if the digital audio bandwidth should be reduced. For example, the evaluation step 718 may compute or retrieve the current audio quality (AQ) signal value and compare it with a quality threshold value. If the current AQ signal value is below the quality threshold value, this would indicate failure of the digital audio signal. In addition or in the alternative, the evaluation step 718 may compute or retrieve the L2 quality value for comparison against a pre-defined threshold. If the L2 quality value is below the pre-defined threshold, failure of the digital audio signal is indicated.

If the signal quality metrics indicate that the digital audio signal is not failing (negative outcome to detection step 718), then no reduction in the bandwidth is required, and the process proceeds via 719, 723 to generate a bandwidth control signal 770 at step 724 which instructs the low pass filter(s) 773 to keep the current bandwidth. However, if the digital audio signal metrics are failing (affirmative outcome to detection step 718), this indicates that conditions are suitable for shrinking or reducing the digital audio bandwidth, provided that the current digital audio bandwidth is not already minimized. This is evaluated at step 720 which detects whether minimum or starting preset bandwidth would be reached by decrementing the current digital audio bandwidth by a preset bandwidth step-down value. If the decremented bandwidth would be smaller than the minimum permitted bandwidth (negative outcome to detection step 720), then the current bandwidth is set to the minimum preset bandwidth and the current timer is reset at step 730, thereby generating a bandwidth control signal 770 at step 730 which instructs the low pass filter(s) 773 to set the digital audio bandwidth to the minimum or starting bandwidth. However, if the decremented bandwidth would not be smaller than the minimum permitted bandwidth (affirmative outcome to detection step 720), the current bandwidth is decremented by the preset bandwidth step-down value and the current timer is reset at step 732, thereby generating a bandwidth control signal 770 at step 732 which instructs the low pass filter(s) 773 to decrement the digital audio bandwidth.

As seen from the foregoing, the low pass filter(s) 773 may be implemented with three audio filters, including a first current bandwidth audio filter, a second step up bandwidth filter, and a third step down bandwidth filter. By feeding all three audio filters the same input audio sample signal, a filter switching mechanism may be used to selectively choose an audio filter output of PCM samples to the audio DAC 774. In particular, the filter switching mechanism is operative to output only one audio filter output to the audio DAC 774 while the system dynamically updates the other two possible (step up/down) audio filter banks for the next audio frame to ensure that these two audio filters are in steady state before the next audio frame. In this way, audio discontinuity is avoided by dynamically switching the audio filter in the fly. In selected embodiments, the filter switching mechanism operates by preparing the next step up/down audio filters during a current audio frame, and flushing out its initial transition states in the two staged HR filter's internal memory. To this end, the switching mechanism may be implemented using three dynamically updated pointers, where the filtered audio is always selected from a steady-state audio filter output, and only one new filter (step up or step down) will be initialized while the other filter will become the next step down or step up audio filter. The step up and step down audio filters only keep track of its internal memory, while the current selected audio filter will output the final filtered audio streams. The output of step up and down filters share a single output buffer that will be discarded.

Figure 8:
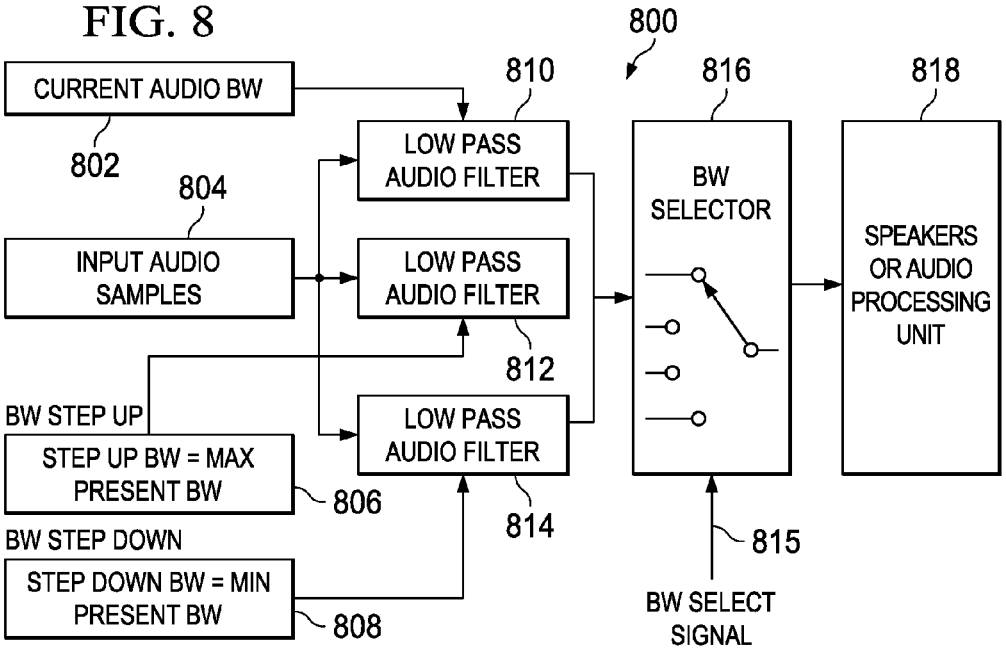
FIG. 8 illustrates an example digital filter implementation for adaptively managing signal bandwidth while blending audio samples of a digital portion of a radio broadcast signal with audio samples of an analog portion of the radio broadcast signal.

Referring now to FIG. 8, there is illustrated an example digital filter implementation 800 for adaptively managing signal bandwidth while blending audio samples of a digital portion of a radio broadcast signal with audio samples of an analog portion of the radio broadcast signal. While implementation details for the filter will be device and resource dependent, the example digital filter 800 includes three filters 810, 812, 814 which may be implemented with three separate Butterworth filters which separately receive the input audio samples 804. The first filter 810 is a low pass audio filter having an upper frequency cutoff at the current BW that is controlled by a current audio bandwidth control input signal 802. The second filter 812 is a low pass audio filter having an upper frequency cutoff at an incremented or step up bandwidth that is controlled by a step up bandwidth control input signal 806. Finally, the third filter 814 is a low pass audio filter having an upper frequency cutoff at a decremented or step down bandwidth that is controlled by a step down bandwidth control input signal 808. The filtered input audio samples from the three filters 810, 812, 814 are multiplexed for output to the speakers or audio processing unit 818 using the bandwidth selector circuit 816. The selector circuit 816 may be controlled by a bandwidth selection signal 815 from the bandwidth management algorithm to select the filtered audio samples by switching between the three filters 810, 812, 814. This will allow for a seamless switch as long the filters have the same delays between them. If the receiver device has more resources, the switching can be more dynamic and be done with a single filter.

As described hereinabove with reference to FIGS. 7 and 8, the current BW computation is dynamically updated at each frame at steps 724, 726/728 and 730/732, depending on the bandwidth adjustment process steps taken. By dynamically updating and tracking the current, step up, and step down bandwidth filters at each audio frame, the selection of the step up and step down BW filters is seamless since there is no need to restart the filters again with new coefficients. In FIG. 8, this is exemplified with the bandwidth inputs 802, 806 and 808 and audio input samples 804 being fed to the three audio filters 810, 812, 814 which are dynamically updated at each audio frame for selection of the desired output by the bandwidth selection circuit 816.

Figure 9:
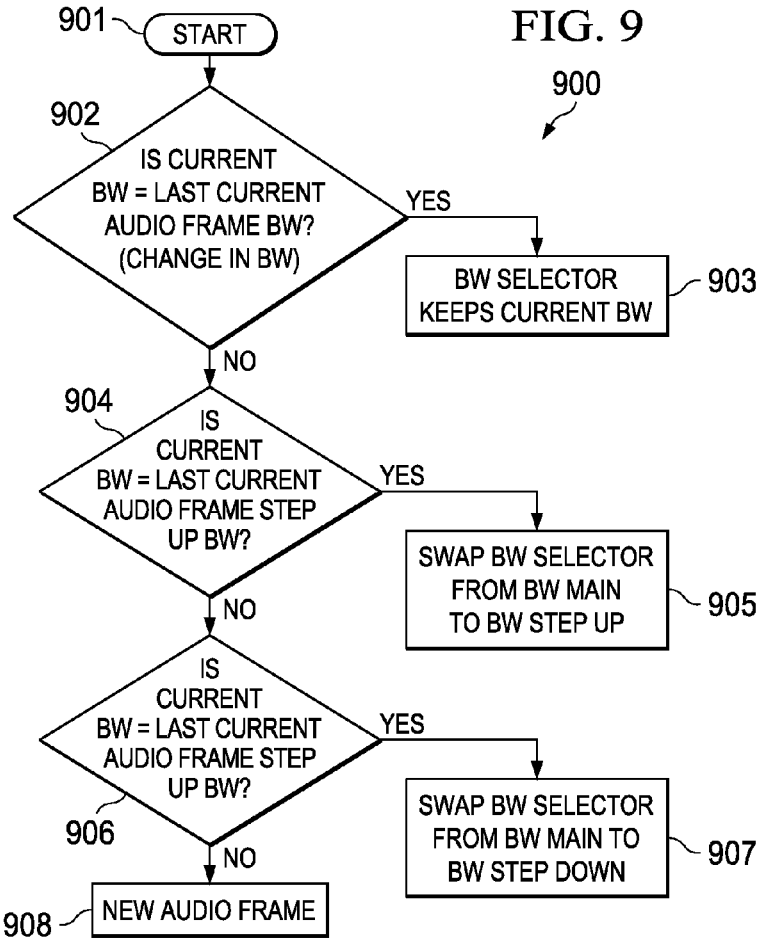
FIG. 9 illustrates an exemplary bandwidth selection process for use with the digital filter implementation shown in FIG. 8.

To illustrate the operation of the digital filter 800 shown in FIG. 8, reference is now made to bandwidth selection process 900 shown in FIG. 9. After the bandwidth selection process starts at step 901, the current digital audio bandwidth is compared to the bandwidth of the last current digital audio frame at step 902. If there is a match (affirmative outcome to detection step 902), then the bandwidth select signal 815 is generated at step 903 so that the bandwidth selector 816 selects the current bandwidth signal from the first low pass audio filter 810. However, if there is no match (negative outcome to detection step 902), the current digital audio bandwidth is compared to the step up bandwidth of the last current digital audio frame at detection step 904.

If the detection step 904 finds a match between the current digital audio bandwidth and the step up bandwidth of the last current digital audio frame (affirmative outcome to detection step 904), then a bandwidth select signal 815 is generated at step 905 for the bandwidth selector 816 to select the bandwidth step up signal from the second low pass audio filter 812. However, if there is no match (negative outcome to detection step 904), the current digital audio bandwidth is compared to the step down bandwidth of the last current digital audio frame at detection step 906.

If the detection step 906 finds a match between the current digital audio bandwidth and the step down bandwidth of the last current digital audio frame (affirmative outcome to detection step 906), then a bandwidth select signal 815 is generated at step 907 for the bandwidth selector 816 to select the bandwidth step down signal from the third low pass audio filter 814. However, if there is no match (negative outcome to detection step 908), then the next audio frame is selected for processing at step 908.

Figure 10:
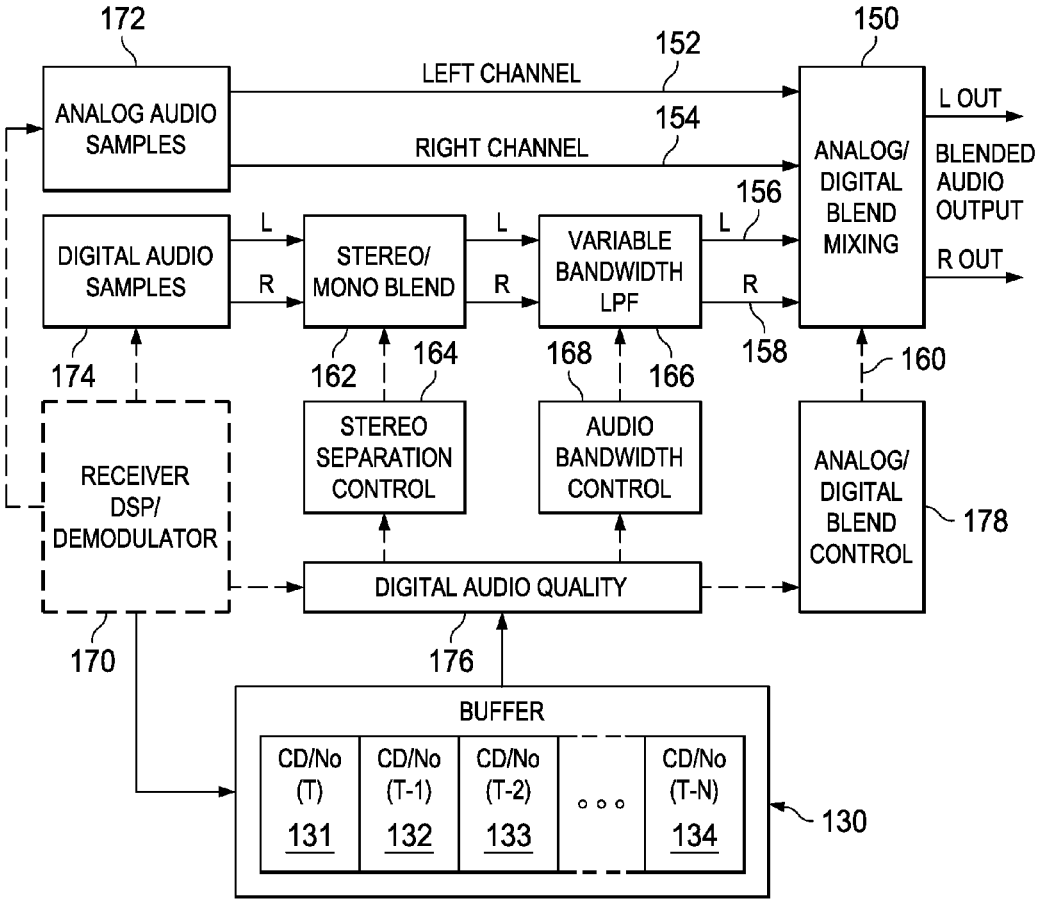
FIG. 10 shows a functional block diagram of a receiver having a smoothed blend function for slowly expanding and reducing the digital audio bandwidth based on the look ahead signal metrics.

As disclosed herein, a method and receiver are provided with a smoothed blend function for dynamically processing the digital signal bandwidth and stereo separation during blending to achieve the smooth transitions by slowly expanding the digital audio bandwidth when the look ahead signal metrics show that the signal quality is increasing, and by rapidly reducing the digital audio bandwidth when the look ahead signal metrics show that the signal quality is degrading. To illustrate the functionality of the smoothed blend function, reference is now made to FIG. 10 which illustrates a functional block diagram for blending analog and digital audio frames at the analog/digital blend mixing module 150. As depicted, the blend mixing block 150 mixes or adds the analog and digital audio samples on lines 152, 154, 156 and 158 as a function of a control input on line 160. The control input 160 is a variable that can change between first and second values to control the amount of digital audio and analog audio to be used to produce the output signal. For example, the control input variable can vary between zero and one, where one indicates an "all digital" mix, zero indicates an "all analog" mix, and a value between zero and one indicates the appropriate mix of analog and digital. With the dynamic bandwidth management and stereo separation techniques disclosed herein, the digital audio path is modified prior to the analog/digital blend mixing, as illustrated a blocks 162, 164, 166, 168, and 176. These functions are the "stereo/mono blend" block 162 with its associated "stereo separation control" block 164, and the "variable bandwidth LPF" block 166 with its associated "audio bandwidth control" block 168. The receiver digital signal processor/demodulator 170 produces analog audio samples 172 and digital audio samples 174. The demodulator 170 also generates digital signal quality values, such as upper layer quality indicators and look ahead signal metrics 131-134 that are provided to the digital audio quality block 176 which detects digital audio packet errors and other digital audio quality indicators. By periodically generating and storing the look ahead signal metrics 131-134 over time, the digital audio quality block 176 effectively obtains a priori knowledge of the incoming signal quality which can be used to dynamically manage the digital audio bandwidth and stereo separation to slowly increase and decrease the digital audio bandwidth to prevent abrupt bandwidth changes which will lead to listener fatigue. The detection of digital audio quality indicators is used to control the stereo separation control 164, audio bandwidth control 168 and analog/digital blend control 178. Either the stereo separation or bandwidth control can be adjusted separately, but maximum benefit may be obtained by adjusting them together.

Figure 11:
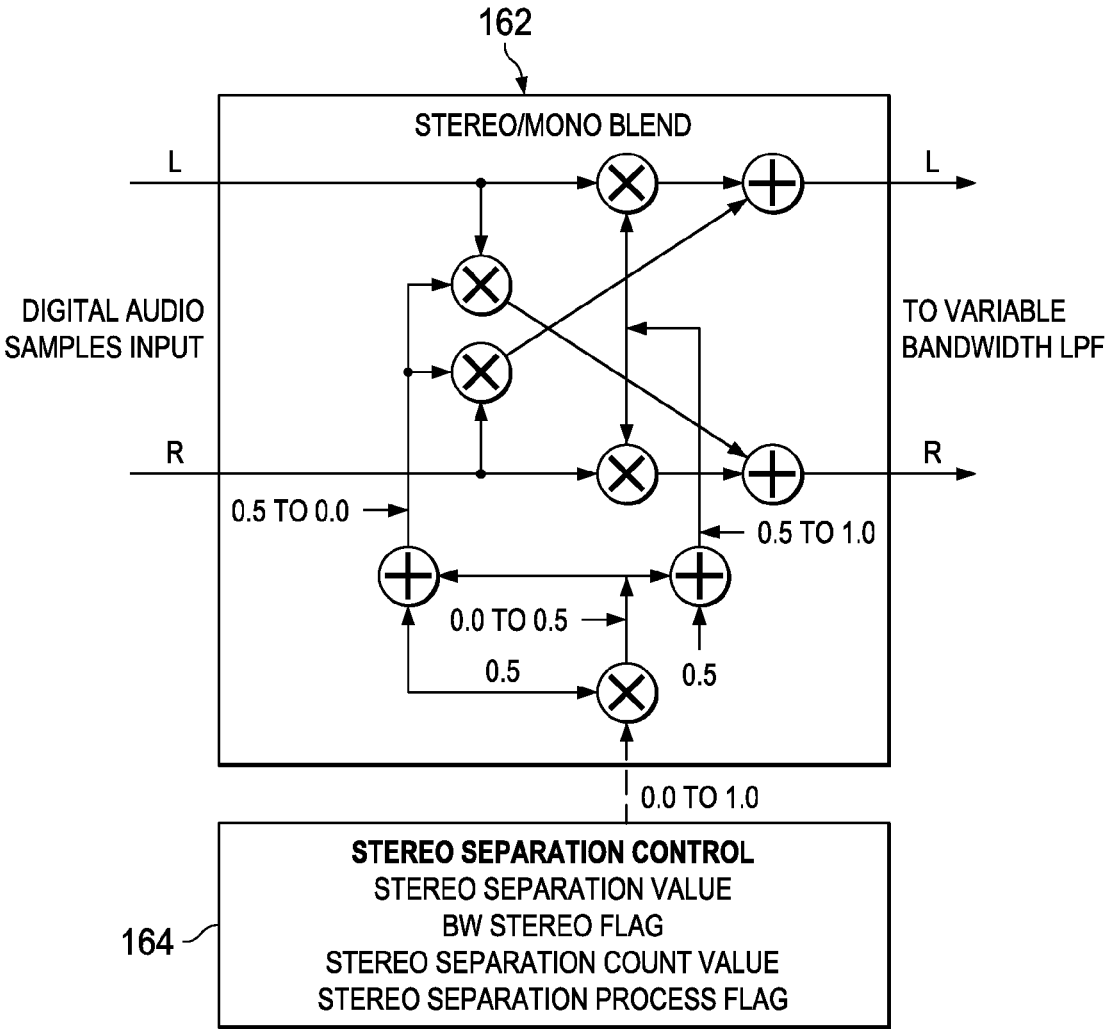
FIG. 11 shows a functional diagram of a stereo/mono blend matrix mixing circuit and associated stereo separation control module.

The stereo/mono blend is a matrix mixing circuit with left (L) and right (R) audio inputs and outputs. FIG. 11 shows a functional diagram of this stereo/mono blend matrix mixing circuit 166 and associated stereo separation control 164 that produces a stereo separation control value (SSCV) that is applied to the matrix mixing circuit to control the mixing of digital audio samples. The SSCV can change between first and second values to control the amount of stereo separation in the digital audio signal using predetermined increment values that are applied when the required number of audio frames having "good" signal quality is met. For example the SSCV can vary between zero and one, where one indicates full stereo, zero indicates full mono, and a value between zero and one indicates reduced stereo separation. The stereo separation control 164 also produces a bandwidth stereo flag (to indicate "stereo" or "mono" modes), a stereo separation count value (to indicate the required number of audio frames having "good" signal quality before increasing the stereo separation value), and a stereo separation process flag (to indicate if the stereo separation process is underway).

Figure 12:
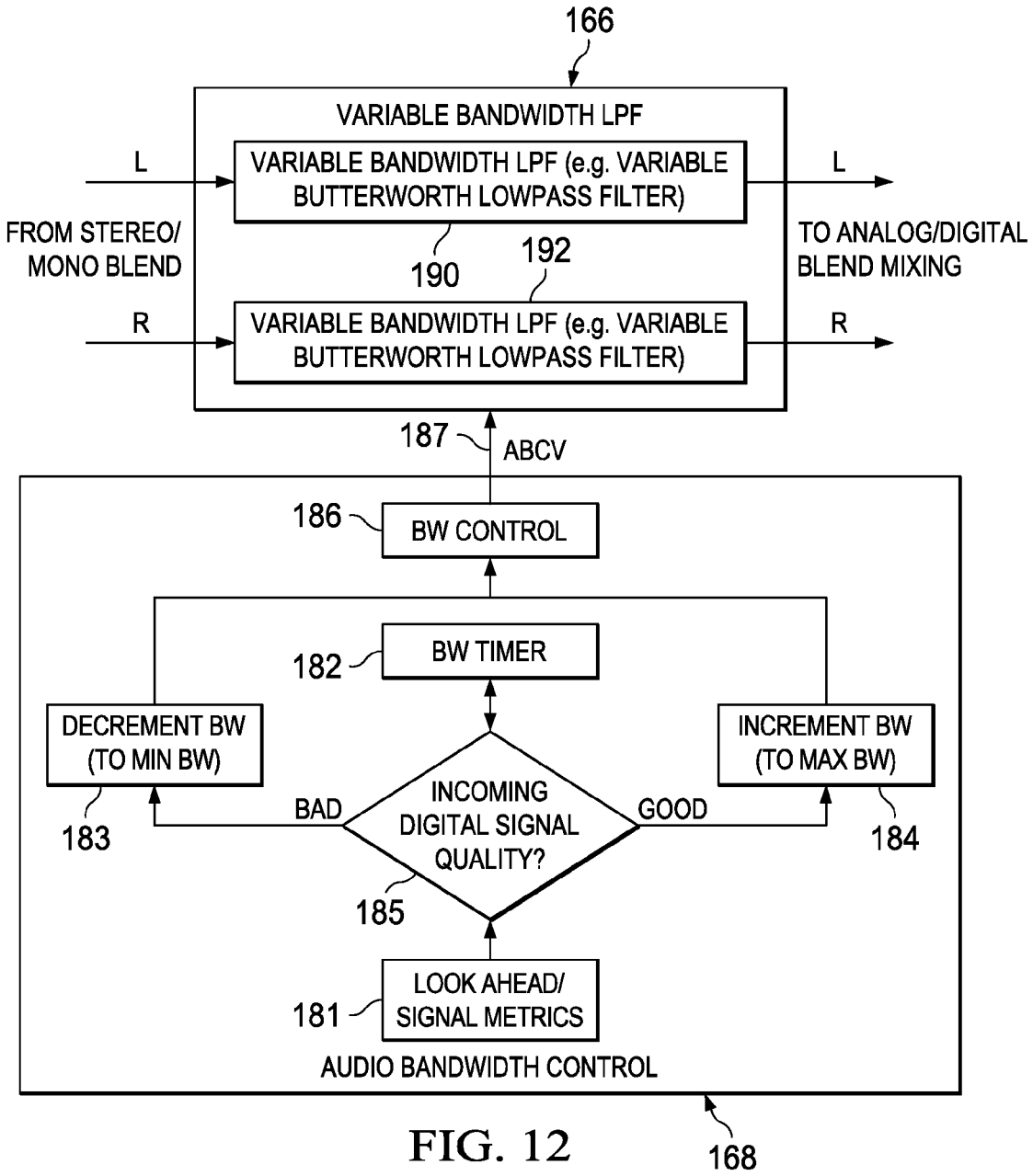
FIG. 12 shows a functional diagram for a variable bandwidth low pass filter and its associated audio bandwidth control.

FIG. 12 shows a functional diagram for a variable bandwidth low pass filter (LPF) 166 and its associated audio bandwidth control 168. This audio bandwidth control 168 uses look ahead signal metrics and upper layer quality indicators 181 to produce an audio bandwidth control variable (ABCV) 187 that can change between first and second values to control the bandwidth of the left and right digital audio signals. For example, the ABCV 187 can vary between a minimum value (e.g., zero) and a maximum value (e.g., one), where the maximum value indicates full bandwidth, and the minimum value indicates minimum bandwidth, and a value between the minimum and maximum values indicates an intermediate bandwidth. As the look ahead signal metrics 181 indicate that the digital signal quality is improving ("Good" outcome from detection step 185), the current bandwidth is slowly incremented or ramped up the current bandwidth to a maximum preset bandwidth (step 184) when the bandwidth control module 186 issues the ABCV 187. However, as the look ahead signal metrics and upper layer quality indicators 181 indicate that the digital signal quality is degrading ("Bad" outcome from detection step 185), the current bandwidth is quickly decremented or reduced to a minimum preset bandwidth (step 183) when the bandwidth control module 186 issues the ABCV 187.

As will be appreciated, the disclosed method and receiver apparatus for processing a composite digital audio broadcast signal and programmed functionality disclosed herein may be embodied in hardware, processing circuitry, software (including but is not limited to firmware, resident software, microcode, etc.), or in some combination thereof, including a computer program product accessible from a computer-usable or computer-readable medium providing program code, executable instructions, and/or data for use by or in connection with a computer or any instruction execution system, where a computer-usable or computer readable medium can be any apparatus that may include or store the program for use by or in connection with the instruction execution system, apparatus, or device. Examples of a non-transitory computer-readable medium include a semiconductor or solid state memory, magnetic tape, memory card, a removable computer diskette, a random access memory (RAM), a read-only memory (ROM), a rigid magnetic disk and an optical disk, such as a compact disk-read only memory (CD-ROM), compact disk-read/write (CD-R/W) and DVD, or any other suitable memory.

By now it should be appreciated that there is provided herein a receiver for an in-band on-channel broadcast signal and associated method of operation for processing a composite digital audio broadcast signal to smooth in-band on-channel signal blending. As disclosed, a received composite digital audio broadcast signal is separated into an analog audio portion and a digital audio portion. The digital audio portion is processed to compute signal quality metric values for a plurality of audio frames which may be stored in memory. The processing may include extracting upper layer signal metric values from the digital audio portion. The digital audio portion in a first audio frame is dynamically adjusted based on one or more signal quality metric values computed for one or more subsequently received audio frames to produce an adjusted digital audio portion. In selected embodiments, the digital audio portion is dynamically adjusted by adjusting an audio bandwidth for the digital audio portion in a first audio frame based on one or more signal quality metric values computed for one or more subsequently received audio frames to produce an adjusted digital audio portion having an adjusted audio bandwidth. This bandwidth adjustment may be implemented by producing a bandwidth control variable for controlling the bandwidth of the adjusted digital audio portion based on the one or more signal quality metric values computed for one or more subsequently received audio frames. The bandwidth adjustment may also be implemented by applying an input audio sample to a plurality of low pass digital audio filters (e.g., Butterworth filters), including a first low pass audio digital filter has an upper frequency cutoff at a current bandwidth, the second low pass audio digital filter has an upper frequency cutoff at a step up bandwidth, and the third low pass audio digital filter has an upper frequency cutoff at a step down bandwidth. In this arrangement, the filtered audio sample outputs from the first, second, and third low pass digital audio filters may be selected using a bandwidth selector that is controlled by a bandwidth selection signal which switches between the first, second, and third low pass digital audio filters based on a comparison of a digital audio bandwidth value from a current audio frame with one or more digital audio bandwidth values from a previous audio frame. In this way, the bandwidth of the digital audio portion of the composite digital audio broadcast signal in a first audio frame may be increased when one or more signal quality metric values computed for one or more subsequently received audio frames indicate that signal quality is improving for the one or more subsequently received audio frames. Alternatively, the bandwidth of the digital audio portion may be decreased when one or more signal quality metric values computed for one or more subsequently received audio frames indicate that signal quality is decreasing for the one or more subsequently received audio frames. In other embodiments, the digital audio portion is dynamically adjusted by adjusting a stereo separation of the digital audio portion in a first audio frame based on one or more signal quality metric values computed for one or more subsequently received audio frames to produce an adjusted digital audio portion having an adjusted stereo separation. The stereo separation adjustment may be implemented by producing a stereo separation variable for controlling the stereo separation of the adjusted digital audio portion based on one or more signal quality metric values computed for one or more subsequently received audio frames. In addition, the analog audio portion of the composite digital audio broadcast signal may be processed to compute analog signal characteristic information (e.g., signal pitch, loudness, or bandwidth characteristic) for use in dynamically adjusting the digital audio portion of the composite digital audio broadcast signal. The adjusted digital portion is blended with analog audio portion to produce an audio output.

In another form, there is provided a method and apparatus for processing a composite digital audio broadcast signal to mitigate intermittent interruptions in the reception of the digital audio broadcast signal. As disclosed, a composite digital audio broadcast signal is received as a plurality of audio frames, and each frame is separated into an analog audio portion and a digital audio portion. For each audio frame, signal quality metric value is computed using the digital audio portion, and then stored in memory. Using one or more look ahead signal quality metric values computed from one or more subsequently received audio frames, a stereo separation of the digital audio portion for each frame is dynamically adjusted to produce an adjusted digital audio portion which may be blended with the corresponding analog audio portion to produce an audio output. The stereo separation may be dynamically adjusted by producing a stereo separation variable if a current bandwidth meets a stereo bandwidth threshold requirement to control stereo separation of the digital audio portion. For example, the stereo separation variable may vary according to a first ramp function having a first rate of change when blending in the analog audio portion and a second rate of change when blending out the analog audio portion. In addition, the bandwidth of the digital audio portion for each frame may be dynamically adjusted by producing a bandwidth control variable to control the bandwidth of the digital audio portion based on one or more look ahead signal quality metric values computed from one or more subsequently received audio frames to produce an adjusted digital audio portion.

In yet another form, there is provided a radio receiver and method of receiving composite digital audio broadcast signals. The radio receiver includes a front end tuner for receiving a composite digital audio broadcast signal in a plurality of audio frames. In addition, the radio receiver includes a processor for separating each frame of the composite digital audio broadcast signal into an analog audio portion and a digital audio portion, computing a signal quality metric value for each audio frame using the digital audio portion from said audio frame, storing the signal quality metric value for each audio frame in memory, dynamically adjusting either stereo separation or bandwidth or both of the digital audio portion for each frame based on one or more look ahead signal quality metric values computed from one or more subsequently received audio frames to produce an adjusted digital audio portion, and blending the analog audio portion with the adjusted digital audio portion to produce an audio output. In selected embodiments, the radio receiver includes first, second, and third low pass digital audio filters which are each coupled to receive an input audio sample, where the first low pass audio digital filter has an upper frequency cutoff at a current bandwidth, the second low pass audio digital filter has an upper frequency cutoff at a step up bandwidth, and the third low pass audio digital filter has an upper frequency cutoff at a step down bandwidth. The radio receiver also includes a bandwidth selector for selecting a filtered audio sample output from the first, second, and third low pass digital audio filters in response to a bandwidth selection signal which switches between the first, second, and third low pass digital audio filters based on a comparison of a digital audio bandwidth value from a current audio frame with one or more digital audio bandwidth values from a previous audio frame.

Although the described exemplary embodiments disclosed herein are directed to an exemplary IBOC system for blending analog and digital signals using digital signal quality look ahead metrics, the present invention is not necessarily limited to the example embodiments which illustrate inventive aspects of the present invention that are applicable to a wide variety of digital radio broadcast receiver designs and/or operations. Thus, the particular embodiments disclosed above are illustrative only and should not be taken as limitations upon the present invention, as the invention may be modified and practiced in different but equivalent manners apparent to those skilled in the art having the benefit of the teachings herein. Accordingly, the foregoing description is not intended to limit the invention to the particular form set forth, but on the contrary, is intended to cover such alternatives, modifications and equivalents as may be included within the spirit and scope of the invention as defined by the appended claims so that those skilled in the art should understand that they can make various changes, substitutions and alterations without departing from the spirit and scope of the invention in its broadest form.

What is claimed is:

1. A method for processing a composite digital audio broadcast signal to smooth in-band on-channel signal blending, comprising:

separating a received composite digital audio broadcast signal into an analog audio portion and a digital audio portion;

processing the digital audio portion of the received composite digital audio broadcast signal to compute a signal quality metric value as a signal-to-noise ratio (SNR) measure for each of a plurality of audio frames, thereby computing signal quality metric values for the plurality of audio frames;

storing the signal quality metric values in memory;

dynamically adjusting the digital audio portion of the composite digital audio broadcast signal in a first audio frame based on one or more of the stored signal quality metric values computed for one or more subsequently received audio frames to produce an adjusted digital audio portion; and blending the analog audio portion with the adjusted digital audio portion to produce an audio output.

2. The method of claim 1, where dynamically adjusting the digital audio portion comprises adjusting an audio bandwidth for the digital audio portion in a first audio frame based on one or more signal quality metric values computed for one or more subsequently received audio frames to produce an adjusted digital audio portion having an adjusted audio bandwidth.

3. The method of claim 2, where adjusting the audio bandwidth comprises producing a bandwidth control variable for controlling the bandwidth of the adjusted digital audio portion based on the one or more signal quality metric values computed for one or more subsequently received audio frames.

4. The method of claim 1, where dynamically adjusting the digital audio portion further comprises adjusting a stereo separation of the digital audio portion in a first audio frame based on one or more signal quality metric values computed for one or more subsequently received audio frames to produce an adjusted digital audio portion having an adjusted stereo separation.

5. The method of claim 4, wherein adjusting the stereo separation comprises producing a stereo separation variable for controlling the stereo separation of the adjusted digital audio portion based on one or more signal quality metric values computed for one or more subsequently received audio frames.

6. The method of claim 1, where each of the signal quality metric values is computed in an FM demodulator by extracting a signal-to-noise ratio (SNR) computed from upper and lower primary sidebands provided by a channel state information module.

7. The method of claim 1, where each of the signal quality metric values is computed in an AM demodulator by extracting a signal-to-noise ratio (SNR) computed from upper and lower primary sidebands provided by a binary phase shift key module.

8. The method of claim 1, further comprising processing the analog audio portion of the composite digital audio broadcast signal to compute analog signal characteristic information for use in dynamically adjusting the digital audio portion of the composite digital audio broadcast signal.

9. The method of claim 8, where the analog signal characteristic information comprises a signal pitch, loudness, or bandwidth characteristic for the analog audio portion of the composite digital audio broadcast signal.

10. The method of claim 1, where dynamically adjusting the digital audio portion comprises increasing the bandwidth of the digital audio portion of the composite digital audio broadcast signal in a first audio frame when one or more signal quality metric values computed for one or more subsequently received audio frames indicate that signal quality is improving for the one or more subsequently received audio frames.

11. The method of claim 1, where dynamically adjusting the digital audio portion comprises decreasing the bandwidth of the digital audio portion of the composite digital audio broadcast signal in a first audio frame when one or more signal quality metric values computed for one or more subsequently received audio frames indicate that signal quality is decreasing for the one or more subsequently received audio frames.

12. The method of claim 1, where processing the digital audio portion of the composite digital audio broadcast signal further comprises extracting upper layer signal metric values from the digital audio portion.

13. The method of claim 1, where dynamically adjusting the digital audio portion comprises:

applying an input audio sample to first, second, and third low pass digital audio filters, where the first low pass audio digital filter has an upper frequency cutoff at a current bandwidth, the second low pass audio digital filter has an upper frequency cutoff at a step up bandwidth, and the third low pass audio digital filter has an upper frequency cutoff at a step down bandwidth; and selecting a filtered audio sample output from the first, second, and third low pass digital audio filters using a bandwidth selector that is controlled by a bandwidth selection signal which switches between the first, second, and third low pass digital audio filters based on a comparison of a digital audio bandwidth value from a current audio frame with one or more digital audio bandwidth values from a previous audio frame.

14. The method of claim 13, where the first, second, and third low pass digital audio filters each comprise a Butterworth filter.

15. A method for processing a composite digital audio broadcast signal to mitigate intermittent interruptions in reception of the digital audio broadcast signal, comprising:

receiving the composite digital audio broadcast signal in a plurality of audio frames;

separating each frame of the received composite digital audio broadcast signal into an analog audio portion and a digital audio portion;

computing a signal quality metric value as a signal-to-noise ratio (SNR) measure for each audio frame of the plurality of audio frames using the digital audio portion from said audio frame;

storing the signal quality metric value for each audio frame in memory;

dynamically adjusting a stereo separation of the digital audio portion for each frame based on one or more look ahead signal quality metric values computed from one or more subsequently received audio frames and stored in the memory to produce an adjusted digital audio portion; and blending the analog audio portion with the adjusted digital audio portion to produce an audio output.

16. The method of claim 15, where dynamically adjusting the stereo separation comprises producing a stereo separation variable if a current bandwidth meets a stereo bandwidth threshold requirement to control stereo separation of the digital audio portion.

17. The method of claim 16, where the stereo separation variable varies according to a first ramp function having a first rate of change when blending in the analog audio portion and a second rate of change when blending out the analog audio portion.

18. The method of claim 15, further comprising dynamically adjusting a bandwidth of the digital audio portion for each frame by producing a bandwidth control variable to control the bandwidth of the digital audio portion based on one or more look ahead signal quality metric values computed from one or more subsequently received audio frames to produce an adjusted digital audio portion.

19. A radio receiver comprising:

a front end tuner for receiving a composite digital audio broadcast signal in a plurality of audio frames; and a processor for separating each frame of the received composite digital audio broadcast signal into an analog audio portion and a digital audio portion, computing a signal quality metric value as a signal-to-noise ratio (SNR) measure for each audio frame of the plurality of audio frames using the digital audio portion from said audio frame, storing the signal quality metric value for each audio frame in memory, dynamically adjusting either stereo separation or bandwidth or both of the digital audio portion for each frame based on one or more look ahead signal quality metric values computed from one or more subsequently received audio frames and stored in the memory to produce an adjusted digital audio portion, and blending the analog audio portion with the adjusted digital audio portion to produce an audio output.

20. The radio receiver of claim 19, further comprising:

first, second, and third low pass digital audio filters each coupled to receive an input audio sample, where the first low pass audio digital filter has an upper frequency cutoff at a current bandwidth, the second low pass audio digital filter has an upper frequency cutoff at a step up bandwidth, and the third low pass audio digital filter has an upper frequency cutoff at a step down bandwidth; and a bandwidth selector for selecting a filtered audio sample output from the first, second, and third low pass digital audio filters in response to a bandwidth selection signal which switches between the first, second, and third low pass digital audio filters based on a comparison of a digital audio bandwidth value from a current audio frame with one or more digital audio bandwidth values from a previous audio frame.

* * * * *